US006906472B2

(12) United States Patent
Wong

(10) Patent No.: US 6,906,472 B2
(45) Date of Patent: Jun. 14, 2005

(54) ARTICLES WITH FLASHING LIGHTS

(75) Inventor: Wai Kai Wong, Kowloon (HK)

(73) Assignee: Cheerine Development (Hong Kong) Ltd., Hong Kong (CN)

( * ) Notice: Subject to any disclaimer, the term of this patent is extended or adjusted under 35 U.S.C. 154(b) by 80 days.

(21) Appl. No.: 10/235,880

(22) Filed: Sep. 4, 2002

(65) Prior Publication Data

US 2004/0051474 A1 Mar. 18, 2004

(51) Int. Cl.[7] ..... H05B 37/02

(52) U.S. Cl. ..... 315/200 A; 315/76; 315/241 S; 315/224

(58) Field of Search ..... 315/291, 200 A, 315/241 S, 224, 312, 313, 360, 76, 241 R; 362/103; 36/137; H05B 37/02

(56) References Cited

U.S. PATENT DOCUMENTS

| | | | |
|---|---|---|---|
| 1,597,823 A | 8/1926 | Randolph | |
| 1,933,243 A | 10/1933 | Merolis et al. | |
| 2,572,760 A | 10/1951 | Rikelman | 36/1 |
| 2,634,407 A | 4/1953 | Johnson | 340/321 |
| 2,671,209 A | 3/1954 | Habib | 340/261 |
| 2,671,847 A | 3/1954 | Lerch | 240/6.4 |
| 2,816,284 A | 12/1957 | Campanell | 340/321 |
| 2,849,819 A | 9/1958 | Murphy et al. | 46/230 |
| 2,931,893 A | 4/1960 | Arias et al. | 240/6.4 |
| 2,959,892 A | 11/1960 | Johnson | 46/228 |
| 2,976,622 A | 3/1961 | Shearouse | 36/1 |
| 3,008,038 A | 11/1961 | Dickens et al. | 240/6.1 |
| 3,053,949 A | 9/1962 | Johnson | 200/61 |
| 3,070,907 A | 1/1963 | Rocco | 36/8.3 |
| 3,564,232 A | 2/1971 | Ellerbe | 246/6.4 |
| 3,731,022 A | 5/1973 | Loftus | 200/61.48 |
| 3,800,133 A | 3/1974 | Duval | 240/6.4 K |
| 3,893,247 A | 7/1975 | Dana, III | 36/2.5 K |
| 3,946,505 A | 3/1976 | Dana, III | 36/2.5 K |
| 4,014,115 A | 3/1977 | Reichert | 36/137 |
| 4,020,572 A | 5/1977 | Chiaramonte, Jr. | 36/137 |
| 4,128,861 A | 12/1978 | Pelengaris | 362/103 |
| 4,130,951 A | 12/1978 | Powell | 36/137 |

(Continued)

FOREIGN PATENT DOCUMENTS

| | | |
|---|---|---|
| EP | 0 121 026 A1 | 10/1984 |
| EP | 0 335 467 B1 | 10/1989 |
| EP | 0 773 529 A1 | 5/1997 |
| GB | 2 361 624 A | 10/2001 |
| JP | 54-133766 | 10/1979 |
| JP | 55-80376 A | 6/1980 |
| JP | 5-21188 A | 1/1993 |
| JP | 10232635 | 9/1998 |
| WO | WO 93/11681 | 6/1993 |

*Primary Examiner*—Trinh Vo Dinh
(74) *Attorney, Agent, or Firm*—Brinks Hofer Gilson & Lione

(57) ABSTRACT

Illuminating devices may be added to clothing and accessories worn by persons. Articles to which the illuminating devices may be added include footwear, hair-control articles, belts, suspenders, backpacks, purses, book-bags, vests and the like. The illuminating devices are necessarily compact in nature, consisting primarily of flashing lights and a power-and-control circuit that controls and enables the flashing of the lights. The lights may be flashed sequentially, in-phase, randomly, or in other desirable patterns, and the lights may also fade-on or fade-off. Controls may include an inertial switch, a push-button or touch-switch, and an on-off toggle switch.

21 Claims, 22 Drawing Sheets

U.S. PATENT DOCUMENTS 4,158,922 A 6/1979 Dana, III ..... 36/137
4,231,079 A 10/1980 Heminover ..... 362/106
4,253,253 A 3/1981 McCormick ..... 36/137
4,298,917 A 11/1981 Ware ..... 362/157
4,308,572 A * 12/1981 Davidson et al. ..... 362/103
4,350,853 A 9/1982 Ganyard ..... 200/52 R
4,412,205 A 10/1983 Von Kemenczky ..... 340/331
4,459,645 A 7/1984 Glatter ..... 362/104
4,588,387 A 5/1986 Swenson ..... 446/130
4,701,146 A 10/1987 Swenson ..... 446/130
4,800,469 A 1/1989 Leon ..... 362/72
4,848,009 A 7/1989 Rodgers ..... 36/137
4,870,325 A 9/1989 Kazar ..... 315/178
4,897,947 A 2/1990 Kass-Pious ..... 40/636
4,995,294 A 2/1991 Kashio et al. ..... 84/738
5,016,144 A 5/1991 DiMaggio ..... 362/35
5,033,212 A 7/1991 Evanyk ..... 36/137
5,052,131 A 10/1991 Rondini ..... 36/137
5,113,325 A 5/1992 Eisenbraun
5,188,447 A 2/1993 Chiang et al. ..... 362/103
5,285,586 A 2/1994 Goldston et al. ..... 36/137
5,303,131 A 4/1994 Wu ..... 362/103
5,303,485 A 4/1994 Goldston et al. ..... 36/137
5,313,187 A 5/1994 Choi et al. ..... 340/331
5,343,190 A 8/1994 Rodgers ..... 340/573
5,353,441 A 10/1994 Lazorchak ..... 2/203
5,357,697 A 10/1994 Lin ..... 36/137
5,371,662 A 12/1994 Shen-Ko ..... 362/276
5,381,615 A 1/1995 MacMillan ..... 36/137
5,396,720 A 3/1995 Hwang et al. ..... 36/137
5,400,232 A 3/1995 Wong ..... 362/276
5,406,724 A 4/1995 Lin ..... 36/137
5,408,764 A 4/1995 Wut ..... 36/137
5,419,061 A 5/1995 Barrocas ..... 36/137
5,422,628 A 6/1995 Rodgers ..... 340/573
5,438,488 A 8/1995 Dion ..... 362/103
5,438,493 A 8/1995 Tseng ..... 362/103
5,455,749 A 10/1995 Ferber ..... 362/103
5,456,032 A 10/1995 Matsumoto et al. ..... 40/636
5,457,900 A 10/1995 Roy ..... 36/137
5,461,188 A 10/1995 Drago et al. ..... 84/600
5,463,537 A 10/1995 Trattner et al. ..... 362/103
5,465,197 A 11/1995 Chien ..... 362/203
5,477,437 A 12/1995 Lach ..... 362/252
5,483,759 A 1/1996 Silverman ..... 36/137
5,485,358 A 1/1996 Chien ..... 362/106
5,490,338 A 2/1996 Hwang et al. ..... 36/137
5,495,136 A 2/1996 Chiang et al. ..... 36/3.6
5,495,682 A 3/1996 Chen ..... 36/2.6
5,500,635 A 3/1996 Mott ..... 340/323 R
5,508,899 A 4/1996 McCormick ..... 362/103
5,546,681 A 8/1996 Goldston et al. ..... 36/137
5,550,721 A 8/1996 Rapisarda ..... 362/205
5,566,479 A 10/1996 Gray et al. ..... 36/137
5,575,554 A 11/1996 Guritz ..... 362/103
5,577,828 A 11/1996 Nadel et al. ..... 362/103
5,599,088 A 2/1997 Chien ..... 362/103
5,604,999 A 2/1997 Barker ..... 36/137
5,644,858 A 7/1997 Bemis ..... 36/137
5,663,614 A 9/1997 Weng et al. ..... 315/360
5,683,164 A 11/1997 Chien ..... 362/78
5,709,464 A 1/1998 Tseng ..... 362/276
5,732,486 A 3/1998 Rapisarda ..... 36/137
5,746,499 A 5/1998 Ratcliffe et al. ..... 362/103
5,746,500 A 5/1998 Chien ..... 362/103
5,754,064 A 5/1998 Chien ..... 327/108
5,758,946 A 6/1998 Chen ..... 362/103
5,812,063 A 9/1998 Weng et al. ..... 340/815
5,813,148 A 9/1998 Guerra ..... 36/137
5,866,987 A 2/1999 Wut ..... 315/119
5,894,201 A 4/1999 Wong ..... 315/241 S
5,903,103 A 5/1999 Garner ..... 315/76
5,932,975 A 8/1999 Wut ..... 315/119
5,934,784 A 8/1999 Dion ..... 362/103
5,969,479 A * 10/1999 Wong ..... 315/200 A
6,012,822 A 1/2000 Robinson ..... 362/103
6,065,851 A 5/2000 So ..... 362/103
6,104,140 A 8/2000 Wut et al. ..... 315/200 A
6,140,934 A * 10/2000 Lam ..... 340/815.4
6,145,999 A 11/2000 Van Derlande ..... 362/252
6,164,794 A 12/2000 Rodgers ..... 362/103
RE37,220 E 6/2001 Rapisarda et al. ..... 362/189
6,280,045 B1 8/2001 Anteby et al. ..... 362/103
6,348,766 B1 * 2/2002 Ohishi et al. ..... 315/200 A
6,354,712 B1 3/2002 Anteby ..... 362/103
6,360,615 B1 3/2002 Smela ..... 73/862
6,408,545 B1 6/2002 Song ..... 36/127
6,525,487 B2 2/2003 Wei ..... 315/200 A
6,619,812 B2 9/2003 Rapisarda ..... 362/103
2003/0137852 A1 7/2003 Rapsirada ..... 362/570

* cited by examiner

ARTICLES WITH FLASHING LIGHTS

FIELD OF THE INVENTION

This invention relates to clothing and accessories, and more particularly to an improved system for illuminating devices incorporated into clothing and accessories.

BACKGROUND OF THE INVENTION

Lighting systems have been incorporated into footwear, generating distinctive flashing of lights for a person wearing the footwear. These systems generally have an inertial switch, so that when a runner's heel strikes the pavement, the switch moves in one direction or another, triggering a response by at least one circuit that typically includes a power source and a means for powering and controlling the lights. The resulting light flashes are useful in identifying the runner, or at least the presence of a runner, because of the easy-to-see nature of the flashing lights. Thus, the systems may contribute to the fun of exercising while adding a safety feature as well.

These lighting systems, however, suffer from a number of deficiencies. There is typically no on-off switch for the lighting system, and thus the system is "on" all the time, draining the power source, which is typically a small battery. Even if the only portion of the system that is operating is an oscillator or timer, the power drain over time is cumulative, thus leading to shorter-than-desirable battery life.

Another deficiency is the limited utility of the system, confined as it is to footwear. There may be other articles of clothing that could incorporate or add a lighting system, useful for decorative or safety purposes, or at least to alert others to the presence of the person wearing the article, such as persons moving or stationary in a construction, high-traffic or otherwise potentially-hazardous situation. In addition to articles of clothing, the lighting system could potentially be useful on accessories or objects that are worn by or on or near a person, such as a back-pack, a book-bag, a baby-carriage, a brief case, and the like. Prior art systems, such as those disclosed in U.S. Pat. No. 5,894,201, however, do not include these applications.

Another deficiency is the nature of the inertial switch, such as the one depicted in U.S. Pat. No. 5,969,479, which is hereby incorporated by reference in its entirety. The lighting system will only be turned on when the inertial switch is activated. Because the lighting system is incorporated into footwear, there may be no other switch, and thus the opportunities for turning the system on or off are limited to actuating the inertial switch, i.e. to running. It would be desirable to have some other means for turning the lighting system on and off. The present invention is directed at correcting these deficiencies in the prior art.

SUMMARY

One embodiment of the invention is an illuminating system for a personal item. The illuminating system comprises a switch for controlling the illuminating system. The system also comprises a plurality of secondary gates, and means for storing and generating at least two patterns of signals that control the secondary gates, the means for storing and generating connected to the plurality of secondary gates and the switch. The system also comprises a plurality of lamps for illuminating the personal item, the lamps selected from the group consisting of incandescent lamps, LEDs, bi-color LEDs, and tri-color LEDs, wherein the means for generating causes the plurality of lamps to flash in a pattern selected by the user with the switch.

Another embodiment of the invention is a method for illuminating a personal item with a flashing light system. The method comprises selecting at least one pattern of signals from at least two patterns of signals stored in a memory of the system. The method also includes generating the at least one pattern of signals to control a plurality of secondary gates and the lamps, the lamps selected from the group consisting of incandescent lamps, LEDs, bi-color LEDs, and tri-color LEDs. The method also comprises controlling a timing and the at least one pattern of illumination with a primary gate.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PRESENTLY PREFERRED EMBODIMENTS

Figure 1:
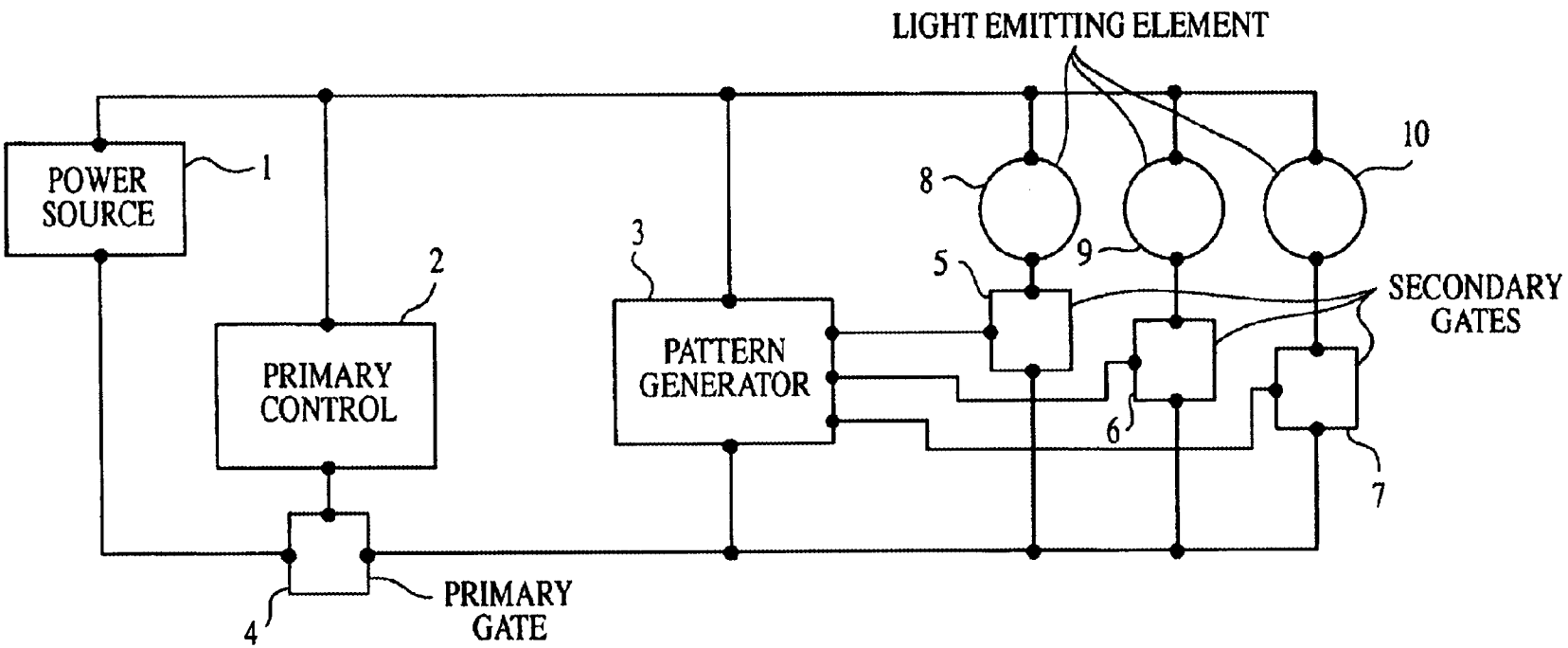
PRIOR ART FIG. 1
FIG. 1 is a block diagram of a circuit for flashing LEDs.

Lighting or illumination systems for decoration or safety on clothing and personal articles must necessarily be compact and light-weight, so that the article to be illuminated can be easily adapted to receive and hold the illumination system. FIG. 1 represents a block diagram of such a system. The Illumination system depicted in FIG. 1 comprises a power source 1, a primary control means 2, a pattern generation means 3 and a primary gate 4. There is a plurality of lamps 8, 9 and 10, secondary gates 5, 6, and 7, and a pattern-generation means 3 for generating a pattern of signals to control the secondary gates 5, 6 and 7. The primary control means 2 controls the opening and closing of the primary gate 4. When the primary gate 4 is closed, it enables the flow of current through the circuit, allowing the circuit to operate. The pattern-generation means 3 generates a pattern of signals and each generated signal separately controls the opening and closing of a respective secondary gate 5, 6 or 7. Secondary gate 5 is connected with lamp 8, secondary gate 6 is connected with lamp 9, and secondary gate 7 is connected with lamp 10. When one of the secondary gates 5, 6 and 7 is closed and the primary gate is closed, the current flows through the respective lamp 8, 9 or 10, allowing the respective lamp to illuminate. In a preferred embodiment, the power source 1 is a battery, the primary gate 4 and secondary gates 5, 6 and 7 are transistors, the primary control means 2 is a switch, the pattern-generation means 3 is a pattern-generation circuit (e.g., a counter), and the lamps 8, 9 and 10 are light-emitting diodes (LEDs).

Figure 2:
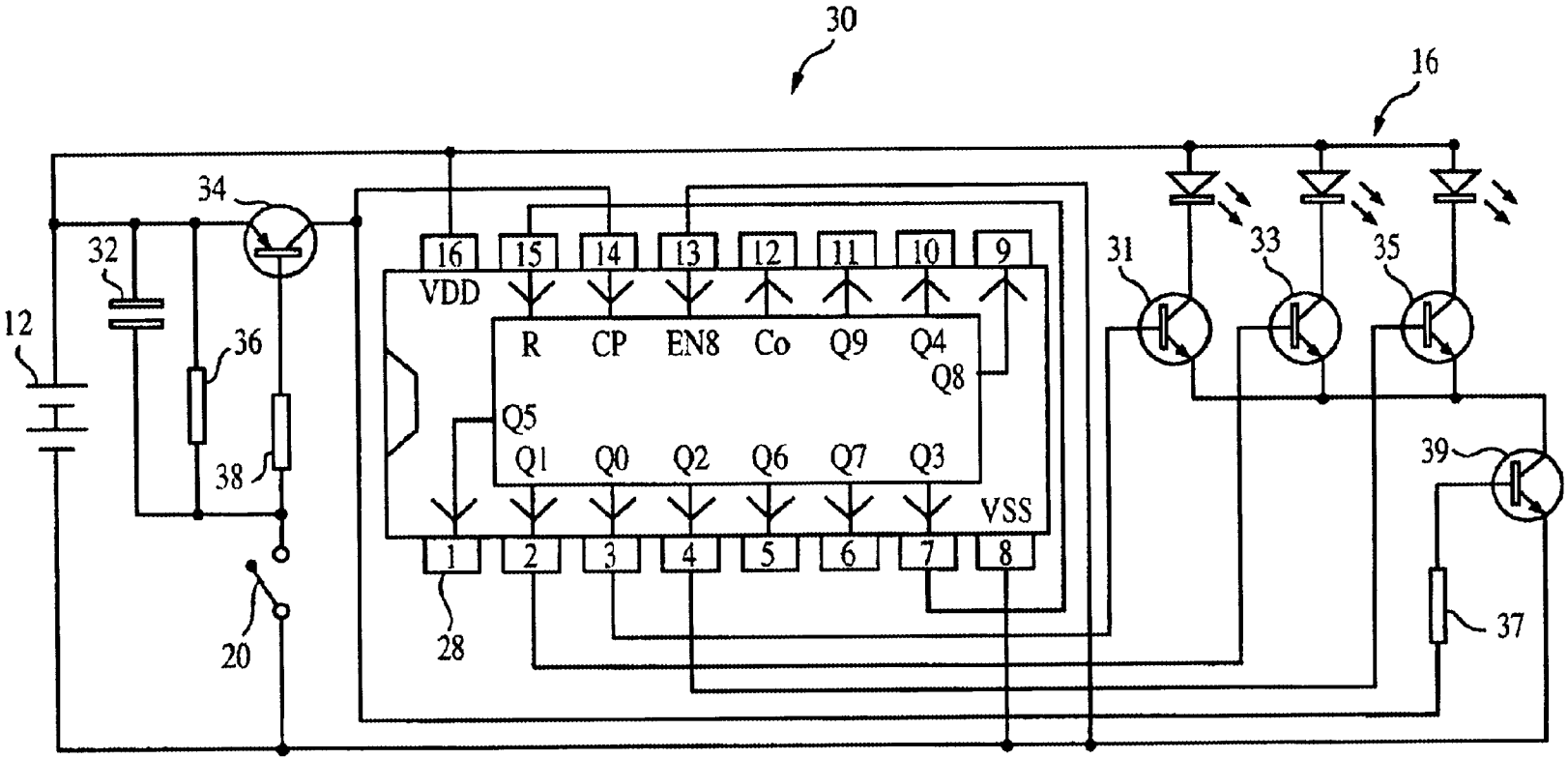
FIG. 2 PRIOR ART
FIG. 2 is a prior art circuit for controlling an illumination system.

A simplified prior art circuit for controlling an illumination system is depicted in FIG. 2. The illumination system 30 includes a battery 12 as a power source, such as a 3-V battery. There is also an inertial switch 20, capacitor 32, resistor 36 and gate resistors 37, 38, primary control transistors 34, 39, signal generator or decade counter 28, LEDs 16, and secondary control transistors 31, 33, 35. Primary control transistors 34, 39 act as switches with their emitters connected respectively to the positive and negative terminals of the power supply, and their collectors connected respectively to the signal generator or decade counter 28 and the emitters of LEDs 16. When inertial switch 20 is closed by a strike of a runner's heel, lights 16 begin to flash, one at a time. When switch 20 closes, primary control transistors 34, 39 also close. Decade counter 28 is connected to the power supply through terminals 8 and 16, Vdd and Vss, and is now started by the pulse to the CP input on pin 14. This begins operation of the decade counter and its outputs, typically in a sequential output. In the example shown, output Q0 (pin 2) turns on the gate of secondary control transistor 31, thus completing the circuit for the first LED 16 from the positive pole of the power supply to negative, through secondary control transistor 31 and primary control transistor 39. If the decade counter goes through its outputs sequentially, then Q0 will be followed by Q1 and then Q2, and so on, thus closing transistors 31, 33, 35, and so on, and flashing LEDs 16 one at a time. The charge on the capacitor 32 will wane, the timing depending on resistors 36 and 38, and the circuit will eventually cease to function. Another strike of the runner's heel will activate switch 20, capacitor 32 will be recharged, and the sequence will continue.

Figure 3:
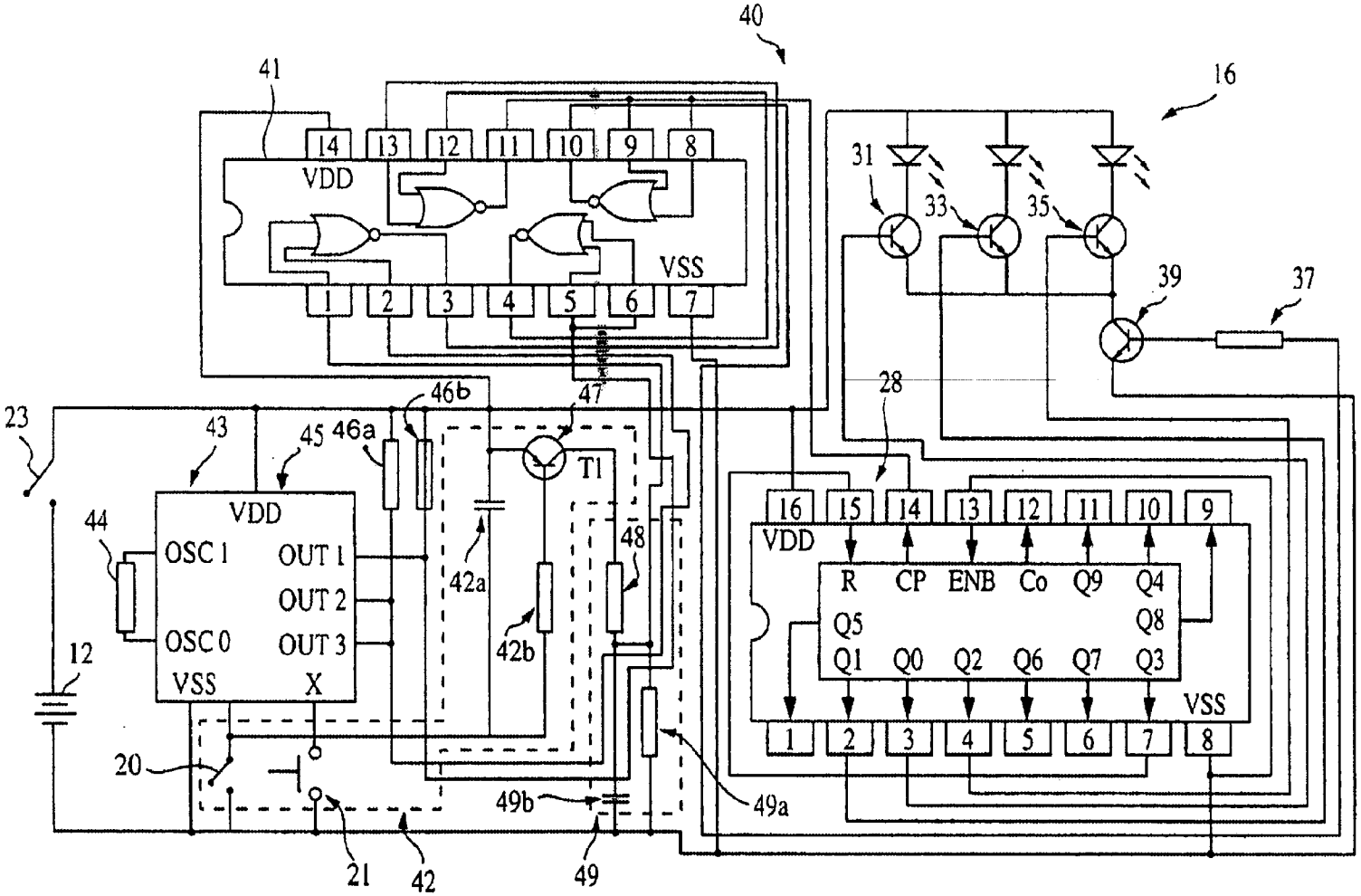
FIG. 3 depicts an improved circuit for controlling an illumination system.

An improved version of an illumination circuit is depicted in FIG. 3, which specifically adds a flash driver circuit 43 having an oscillator, and a pulse generating circuit, as well as a touch switch 21. FIG. 3 depicts a more sophisticated illumination system 40, incorporating a power supply 12, LEDs 16, a switch 20, a triggering circuit 42, a pulse generating circuit 41, flash driver 43 and an output controller or decade counter 28. This circuit connects the LEDs 16 by means of secondary control transistors 31, 33, 35 through primary control transistors 39 and 47. The circuit adds flash driver 43 and its control resistor 44, providing a clock signal to the pulse generating circuit 41 and the output controller 28. In addition, a timing circuit is provided by means of an RC circuit 49 (in dashed lines), including resistor 49*a* and capacitor 49*b*. The RC circuit 49 provides a period of time (several RC time constants) during which the pulse-generating circuit 41 is on, and thus during which it is possible for LEDs 16 to flash.

The triggering circuit 42 (in dashed lines) includes switches 20, 21, primary control transistor 47, capacitor 42*a* and resistor 42*b*. The emitter of primary control transistor 47 connects to the positive terminal of power supply 12, while the collector of primary control transistor 47 is connected to resistor 48. As the voltage across resistor 48 and capacitor 42*a* rises, flash circuit 43 receives a signal from triggering circuit 42 and generates output signals to the pulse generating circuit 41. Decade counter 28 enables secondary control transistors 31, 33, 35, each turning on an LED, and enabling them to flash in desired patterns or sequences. Flash circuit 43 may also include a memory 45 for storing patterns of flashing. Primary control transistor 39 also acts as a switch, connected with its collector to the emitters of the LEDs 16 and with its emitter to the negative terminal of the power supply 12. Control resistor 37 limits the voltage to the gate of transistor 39 from pulse-generating circuit 41. The rest of the circuit is as described for the previous examples. Outputs 1, 2, and 3 connect to LEDs 16 via resistors 46*a*, 46*b*.

Figure 4:
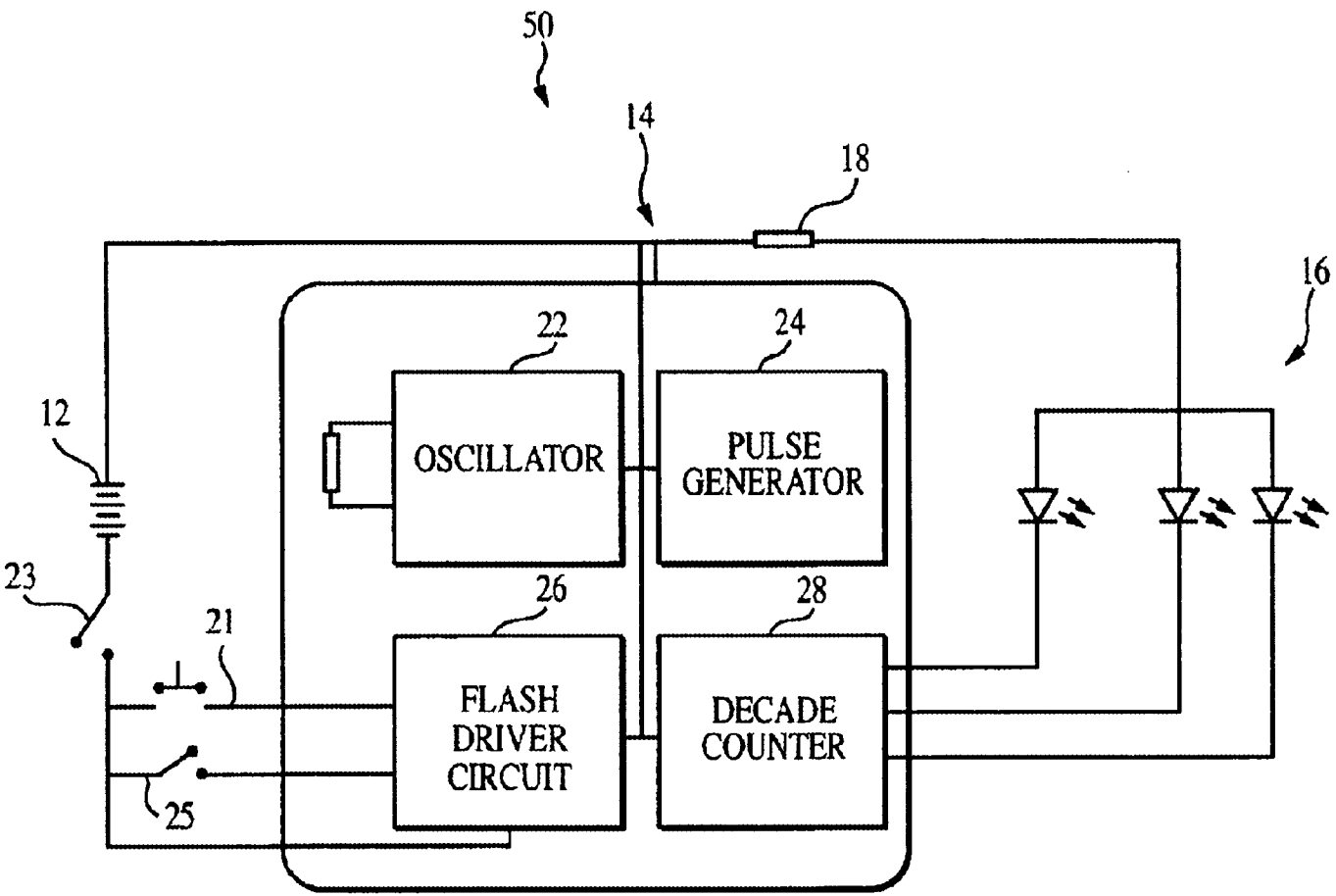
FIG. 4 is a block diagram of an improved system for controlling an illumination system.

A block diagram of an improved circuit 50 with more versatile switching capabilities is depicted in FIG. 4. The improved circuit 50 includes a power supply 12, a control section 14, and LEDs 16. The control section 14 may include an oscillator circuit 22, a pulse generator circuit 24, a flash driver circuit 26, and an output controller or decade counter 28. The circuit may include a touch switch 21, a power on/off switch 23, and at least one additional switch 25. Using touch switch 21, the circuit may be energized by a touch from a user. The circuit may also be activated by the at least one additional switch 25, such as an inertial switch. In addition to the touch-switch 21, another switch, toggle-switch 25 may be used in addition to, or in place of, either or both of the on/off switch 23 and the touch-switch 21. On/off switch 23 and additional switch 25 may provide several differences and advantages over previous switches discussed. On/off switch 23 may be a toggle switch.

On/off switch 23 will allow the power supply a respite from use during transportation, storage, or other periods of non-use, saving the battery and allowing greater economy for the user. If additional switch 25 is a toggle switch, it will allow the user to simply switch the circuit "on," so that continual charging and re-charging of a timing circuit capacitor to keep the circuit running is not necessary. This would be advantageous when the user will not be continually closing an inertial switch, or does not wish to continue reaching to push a touch-button. This would be the case when the user wishes for the lights to continually flash without repeatedly pushing a button.

In one embodiment, using the touch-switch 21, alone or in combination with the toggle switch 23, the pulse generator 24 and decade counter output controller 28 may be programmed so that each time the touch-switch 21 is actuated, a different pattern of lights is generated. For instance, each time touch switch 21 is energized or touched, the pulse generator 24 or decade counter 28 may be incremented, and a stored different pattern of flashes used. Thus, a first touch may generate a first pattern of flashing lights, while a second touch may generate a different pattern and a third touch yet another pattern. For example, if there are three lights, a first sequence may generate a 1-2-3-1-2-3- pattern, while a second touch may generate a 1-2-3-2-1-2-3-2-1- pattern, and the third touch 1-2-3-3-2-1-1-2-3-3-2-1, and so forth. Of course, if there are more than three lights, more patterns and sequences are possible. Such complicated patters are not necessary, and there may be only two patterns, such as a sequential pattern, 1-2-3, or an in-phase pattern, in which more than one light goes on at a time. An example of such a pattern may consist of flashing lights 1 and 4, followed by flashing lights 2 and 5, followed by flashing lights 3 and 6, and so on.

Figure 5:
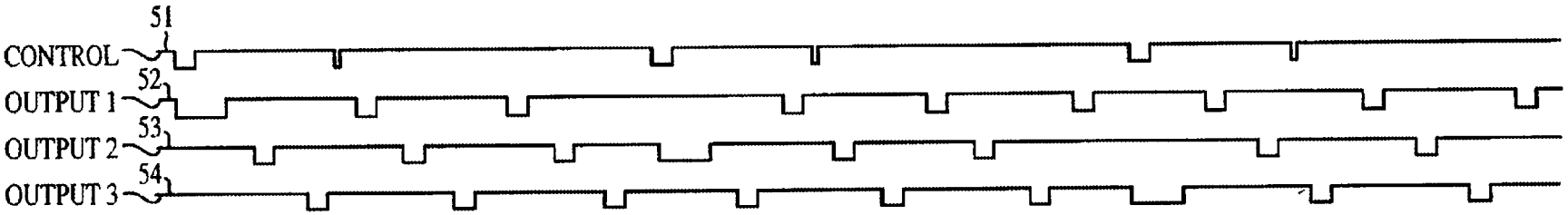
FIGS. 5–8 depict illumination patterns for the LEDs of the improved system.
Figure 6:
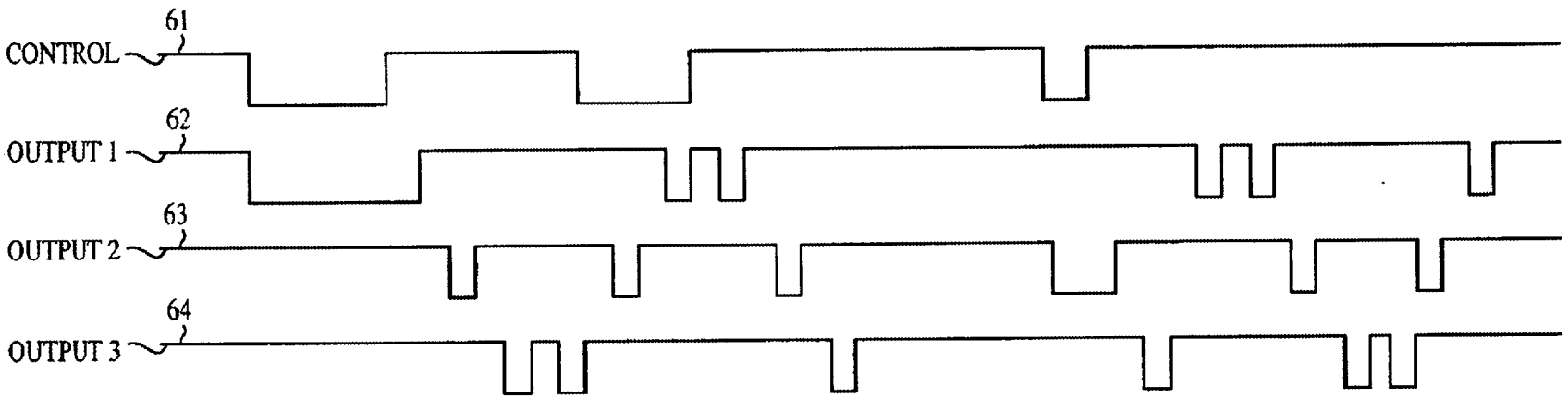

Examples of patterns are depicted in FIGS. 5–8. Note that each time there is an assertion of a control signal (down tick or falling edge on control line), the pattern of illumination changes. In general, a lamp is on when the output signal that controls that lamp is low, and the lamp is off when the control signal that controls that lamp is high. The control signal may be caused by the user depressing the touch-button switch described above, or may instead be a timed sequence, changing after a set period of time, such as 10 seconds or 30 seconds. FIG. 5 depicts a 1-2-3 pattern for control signal 51 and output signals 52, 53, 54, corresponding to OUT1, OUT2, and OUT3, controlling LEDs 16, as shown in FIG. 3. The pattern includes a longer period of illumination of an output and skips of a particular LED. Notice that each time there is an assertion of control signal 51, the pattern of illumination changes. These sequences may be programmed into the controller or decade counter used to control the LEDs. FIG. 6 includes a depiction of a control signal 61 and output signals 62, 63, 64 to lamps or LEDs. FIG. 6 depicts a varying pattern that may be random, and which changes each time there is a falling-edge or down-tick of the control signal 61 for outputs 1, 2 and 3, respectively 62, 63, 64. Using all three traces, the pattern begins "delay 1-2-3-3-2-1;" the pattern then changes to "1-2-3" on the rising edge of a signal from control pattern 61; and the pattern then changes again to "delay 2-3-1-1-2-3-3-2-1." Delays may also be programmed into the patterns, especially at the start.

Figure 7:
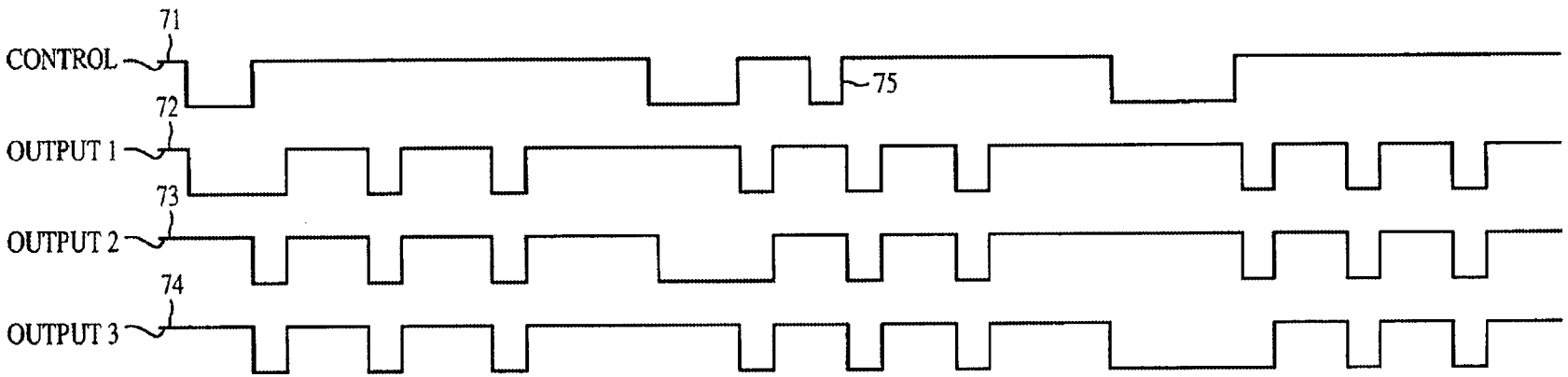

FIG. 7 depicts an "in phase" flashing sequence, in which more than one light may be turned on a time. In this sequence, there is also a sequential variation in the first light to turn on, and in the length of turn-on of one light. The sequence is begun by activating the primary controller or transistor with control signal 71 to control outputs 1, 2, 3, respectively, 72, 73, 74, corresponding to OUT 1, OUT 2, OUT 3, and controlling illumination of LEDs 16 in FIG. 3. The first activation turns on control output 72 first and for a slightly longer period than outputs 73 and 74, which are turned on after control output 72. Thus, there is sufficient power provided for all three LEDs to turn on three times. This flashing is not sequential but "in-phase," since all three are on at the same time. Then all three go off at the same time, then on, off, on and off before the sequence ends. The next time the control is activated by the inertial switch or the touch-switch (or after a set period of time), it is the output 2, 73 which comes on first, followed by output 1, 72 and output 3, 74. Then all three are off, on, off, on and off. The third time the control is activated, output 3 has a longer period than outputs 1 and 2. In one embodiment, additional activation by the inertial switch or the touch switch has no effect on the pattern while it is running. Note that the short spike 75 in FIG. 7, such as an assertion from the control system, does not affect the pattern of lights flashing.

Figure 8:
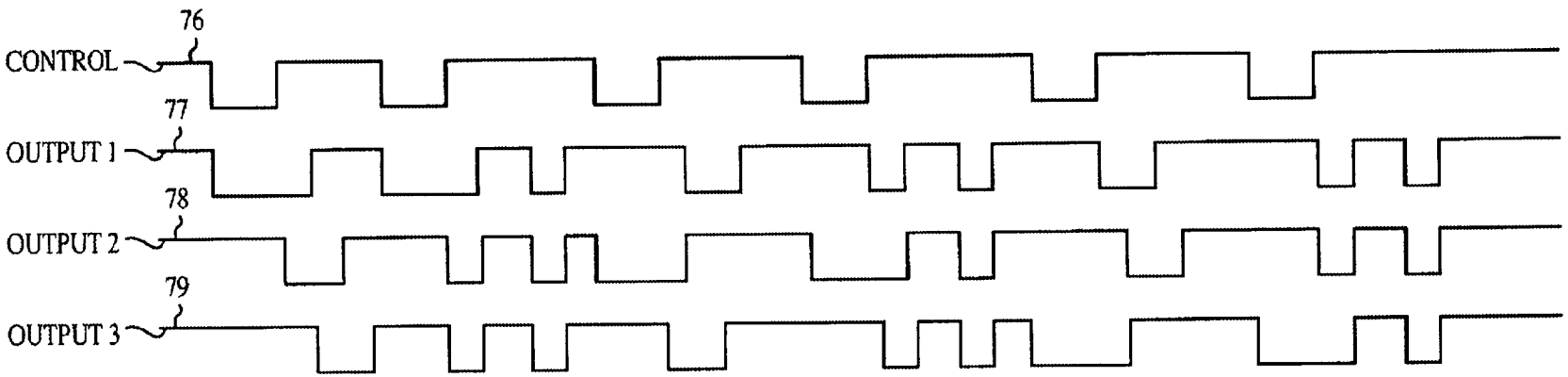

Another embodiment may use previously stored flashing patterns in which any subsequent activation of the inertial switch or touch switch does cause a change in the pattern of flashing lights. In FIG. 8, the decade counter has been programmed with two patterns, a sequential 1-2-3 pattern and an "in-phase" pattern in which all three LEDs are on, then all off. FIG. 8 includes a control output 76, and outputs 77, 78, 79, again corresponding to OUT 1, OUT 2, OUT 3, and LEDs 16 in FIG. 3. Notice that each time the primary control sees a down-tick or falling edge (caused by the inertial switch or the touch switch), the pattern of outputs changes from one pattern to the other, interrupting the pattern as soon as the signal leading or trailing edge registers on control output 76. This system of flashing lights will seem very responsive to user inputs, since it changes the pattern quickly. Random flashes may also be generated using a stored random-number generating program.

Figure 9:
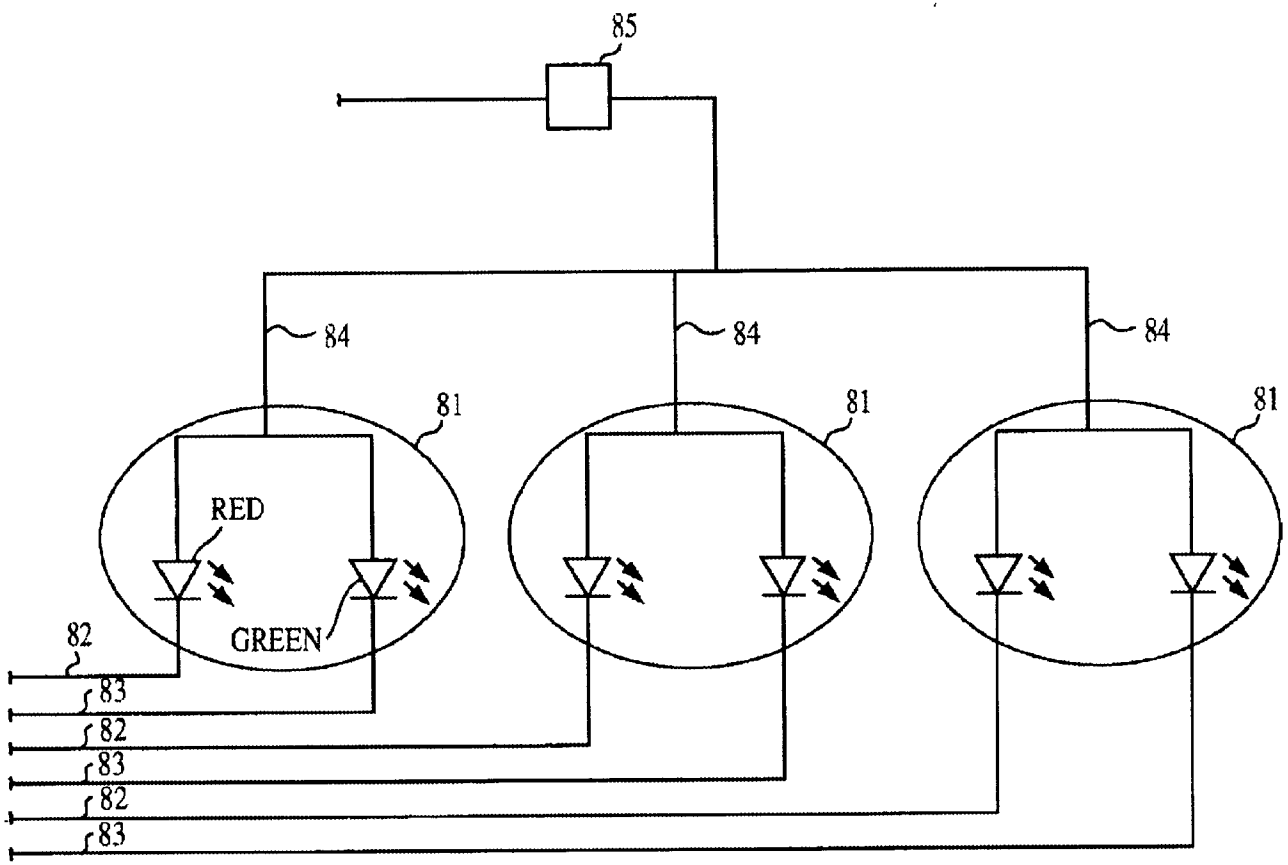
FIGS. 9 and 10 depict two-color LEDs.
Figure 10:
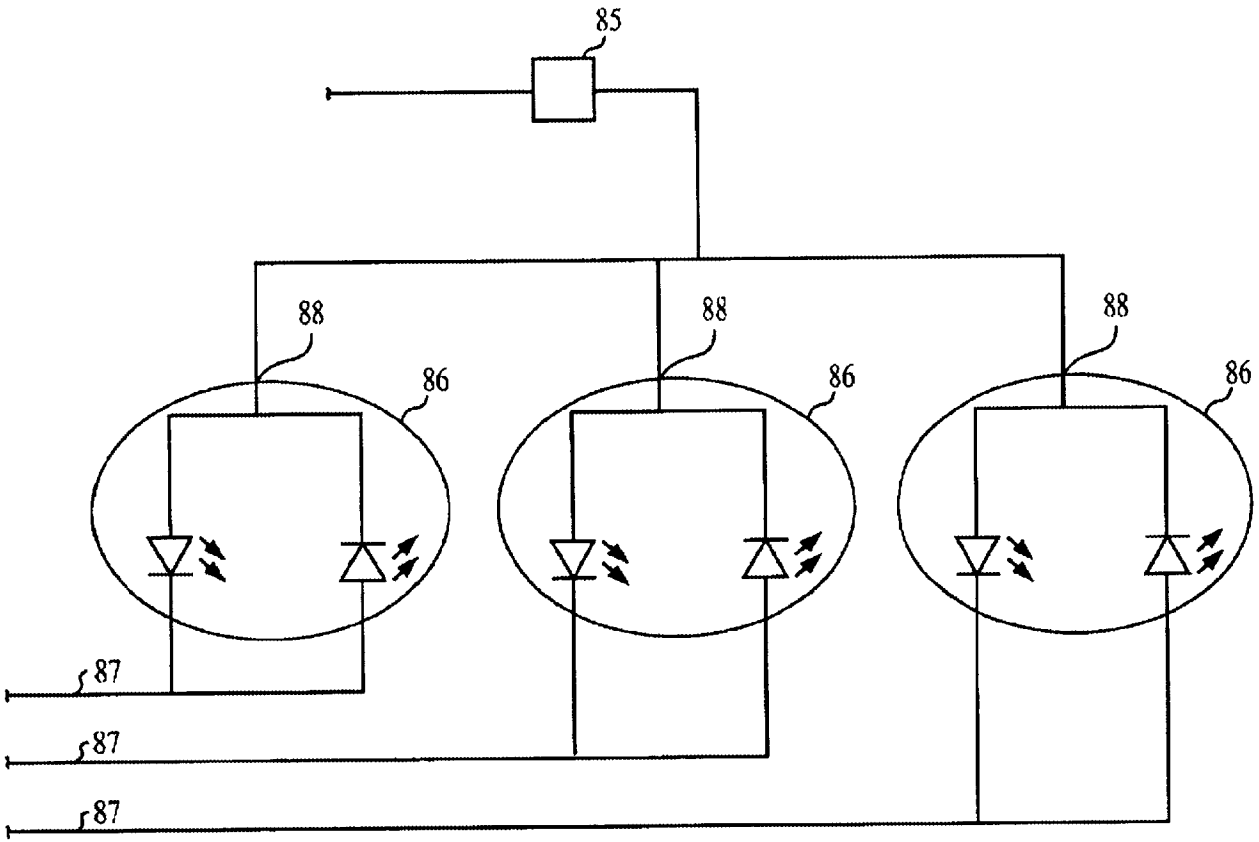
Figure 11:
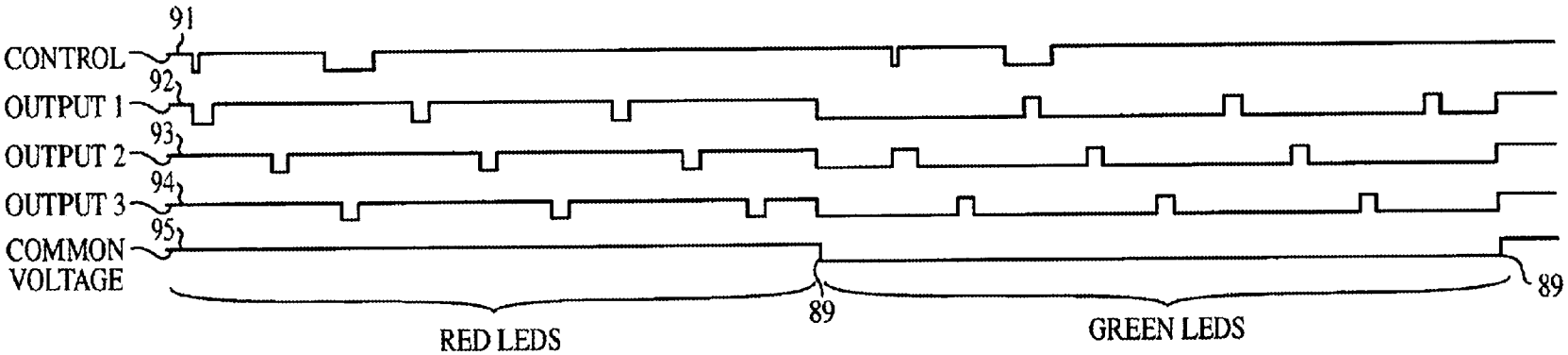
FIG. 11 depicts a possible flashing pattern for an illumination system with two-color LEDs.

Another aspect of the invention uses LEDs that have two colors, such as red and green. The LED may have a common cathode and three leads, including common cathode, red anode and green anode. Other two-color LEDs may have only two leads, in which the anode for one color is the cathode for the other color, and vice versa. Circuits using two-color LEDs are depicted in FIGS. 9–10, and one of many possible flashing patterns is depicted in FIG. 11. FIG. 9 depicts an illumination circuit in which single-color LEDs have been replaced with two-color LEDs 81. These LEDs have three leads, such as those produced by Kingbright Electronic Co., Ltd. of Hong Kong and distributed worldwide. In this embodiment, LED 81 has a red cathode 82, a green cathode 83, and a common anode 84. Also present in the circuit is current limiting resistor 85. The anodes 82, 83 are connected to the outputs of a signal generator, such as a decade counter or other logic circuitry. In this example, the decade counter and the rest of the circuit is capable of reversing current direction. A current-limiting resistor 85 may connect the LEDs to the power supply. The rest of the circuit functions as previously described, with many more sequences of flashing patterns possible, since now the colors may be changed by using, as preferred, the red and green lights.

Another embodiment is shown in FIG. 10 with two-lead LEDs 86. As mentioned above, these LEDs, such as those produced by Chicago Miniature Lamp, Inc., Hackensack, N.J., have only two leads, in which the cathode for one lamp is the anode for the other lamp. In one example, the cathode for the red lamp is electrically common with the anode for the green lamp, and the cathode for the green lamp is common with the anode for the red lamp. An exemplary circuit for these LEDs is shown in FIG. 10. LEDs 86 have two points for connection to the circuit. Point 87 is the cathode for the green LED and is the anode for the red LED. Point 88 is the cathode for the red LED and is the anode for the green LED. The LEDs may be connected to a power supply by limiting resistor 85 and to a signal generator. In this embodiment, the current must reverse direction in order to change from one color of LED to another. This is easily provided by reversing outputs of the control circuit, such as a decade counter.

Using two-color LEDs, many lighting patterns are possible. One of many possible lighting patterns is shown in FIG. 11. The traces include control output 91, Output 1, Output 2 and Output 3, respectively 92, 93, 94, and common output 95. Note that a falling edge or down-tick in these traces for Output 1, 2 and 3 indicates a "red" LED, while a rising edge or up-tick indicates a "green" LED. Control output 91 continues to control the pattern, while the output switches reverse polarity at times 89 when the "common" circuit is reversed, and then reversed again. The pattern begins with "common," as well as outputs 1, 2 and 3, held high or zero volts. The output is triggered by one of the several switches discussed above, and the outputs pulse in sequence, 1-2-3-1-2-3-1-2-3, all in red. After the first polarity change at time 89 (in about the middle of the traces), the common is now low. Outputs 1, 2 and 3, 92, 93, 94 are also changed to low. Note that extra pulses on the control 91 seem to have no effect on traces 92, 93, 94, after the first pulse at the start of the timing, and after the first pulse after first polarity change 89. The pattern continues in sequence 1-2-3, but now with green LEDs lit as the outputs 92, 93, 94 pulse "high" in sequence. The polarity change may be triggered by a length of time (as in FIG. 11) or it may also be caused by a sequence from one or more of the switches that control the illumination circuit.

At present, tri-color LEDs are sold at a premium to single-element LEDs and bi-color LEDs. A tri-color LED may be used in the circuits discussed above for single color and bi-color LEDs, using the appropriate connections for power from anode to cathode, for premium versions of the flashing light systems of the present invention. Other combinations of lights, such as a single filament or dual-filament incandescent lamp, may also be used.

Figure 12:
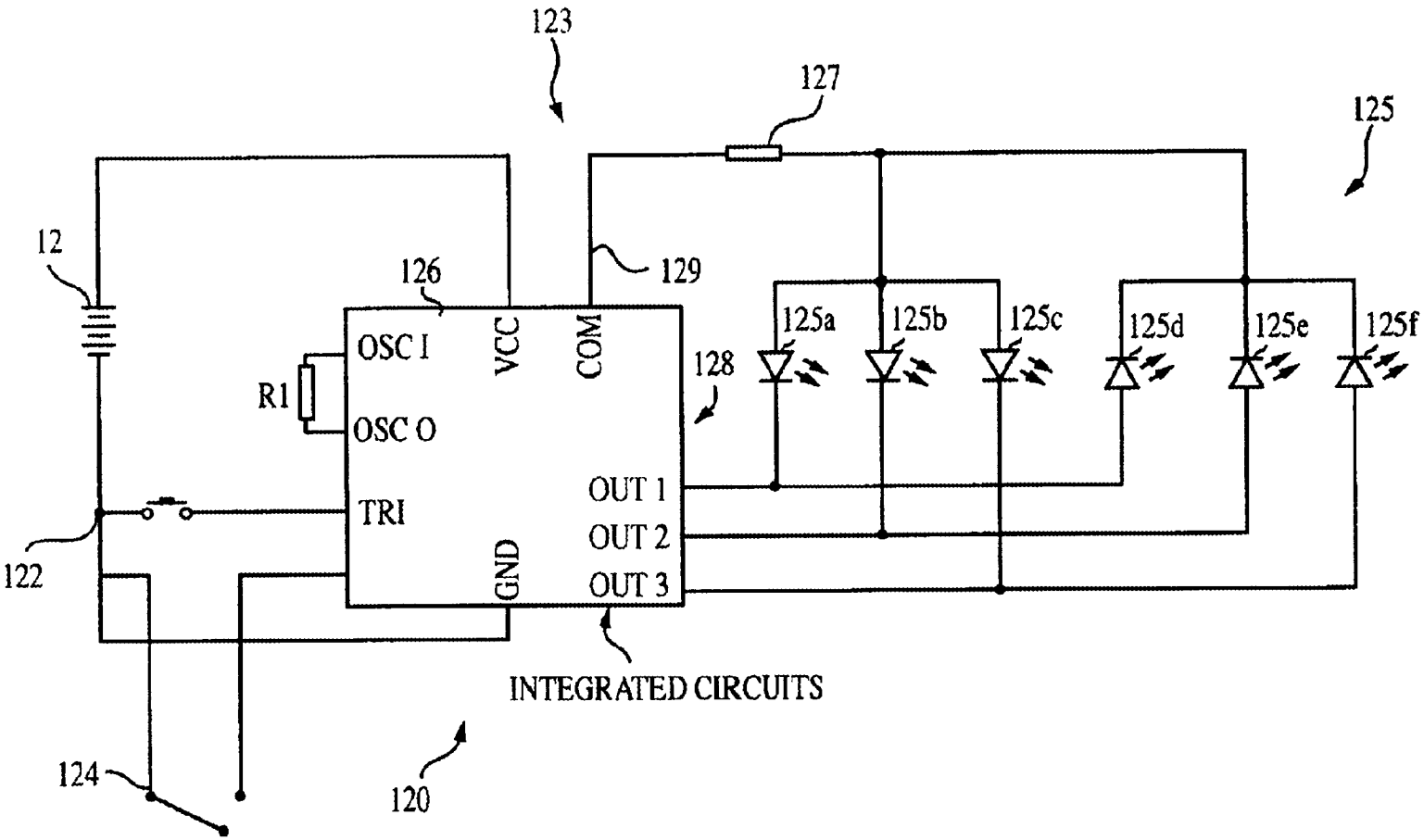
FIG. 12 depicts an illumination circuit using two-color LEDs.

FIG. 12 depicts an embodiment of an illumination system that can take advantage of two-color LEDs. The illumination system 120 will comprise a power source 121, such as a battery. The system will also comprise a control portion 123 and an illumination portion 125, comprising a plurality of LEDs, 125*a*, 125*b*, 125*c*, 125*d*, 125*e*, 125*f*. The system will include at least one switch 124, such as a spring or inertial switch, and preferably has an additional switch 122, such as a touch-switch, which may be located with the control section 123 or may be remotely located. It is understood that other switches may be used in the circuit, including a power on/off switch or a toggle switch. Preferably the illumination system includes an oscillator clock 126 for timing the control portion. The control portion has a plurality of outputs 128 and a common terminal 129. The illumination circuit may have a resistor 127 to control current to the LEDs. The control portion may be an integrated circuit in which a voltage, such as Vcc may be switched between the common terminal 129 and the output terminals 128. At the same time, circuit ground may also be switched to any of the output terminals 128. Note that in this circuit, LED 125*a* and LED 125*d* are both connected with the common terminal (and with the circuit resistor), as well as output 1. Thus, LED 125*a* and LED 125*d* may be equivalent to a two-color, two-lead LED 86 in FIG. 10, with LED 125*b* and LED 125*e* comprising a second two-color, two-lead LED, and LED 125*c* and LED 125*f* comprising a third, two-color, two-lead LED. Other circuits may use three-lead two-color LEDs as depicted in FIG. 9.

Figure 13A:
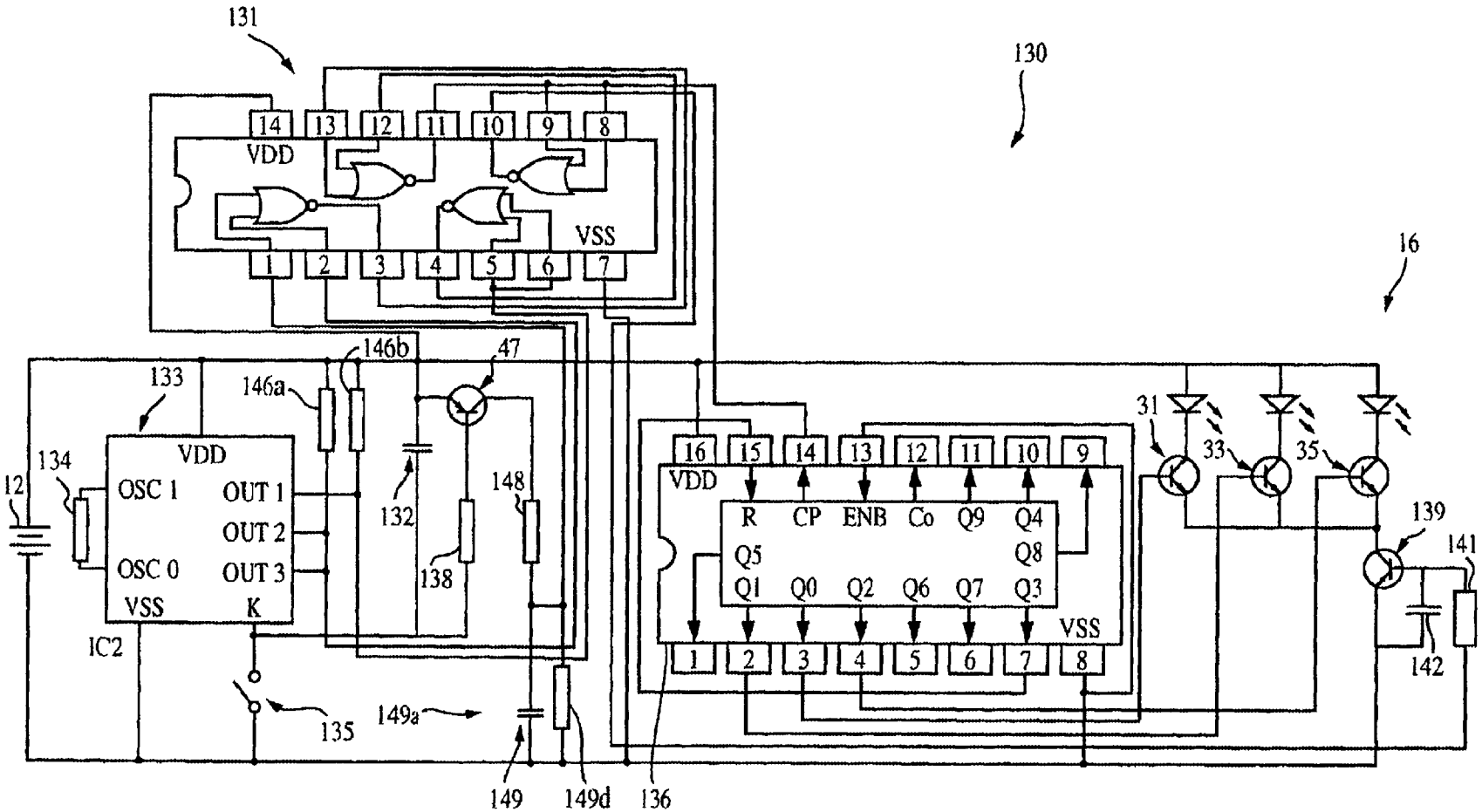
FIGS. 13*a*–13*c* and 14 depict illumination systems with fade-in and fade-out circuits for LEDs.

Other embodiments may include illumination systems in which the lights fade in or fade out. Such embodiments are presented in FIGS. 13*a*–13*c*. These circuits are very similar to each other and to FIG. 3. The illumination system with a fading capability 130 includes a power supply 12, LEDs 16, a switch 135, a pulse-generating circuit 131, flash driver 133 and control resistor 134, and an output controller 136. The circuit connects LEDs 16 to the output controller 136 by transistors 31, 33, 35, and through primary control transistors 47 and 139. Outputs Out 1, Out 2 may be connected via resistors 146*a*, 146*b*. A timing circuit is provided by RC circuit 149, including capacitor 149*a* and resistor 149*d*. The RC circuit provides a period of time (several RC time constants) during which the pulse-generating circuit 131 is on, and thus during which time it is possible to illuminate LEDs 16. Output controller 136 enables secondary transistors 31, 33 35, turning on LEDs in the timing sequence desired. In this circuit, npn control transistor 139 has capacitor 142 connected across the base-emitter junction. Resistor 141 is somewhat greater than resistor 37 in FIG. 3. FIG. 13*a* may be a circuit with both fade in and fade out. In one embodiment of FIG. 13*a*, resistor 134 is 1.5 megohm, resistor 141 is 47K, capacitors 142 and 149*a* are each 47 $\mu$F, and resistor 149*d* is 170K.

When terminal 10 of the pulse-generating circuit 131 changes from high to low, or from low to high, capacitor 142 is used to control the base-emitter voltage of transistor 139, and thus the conductivity of transistor 139. If the pulse-generating circuit (terminal 10) is high and the transistor 139 is turned on, at least one of LEDs 16 may be "on." If the voltage then goes low, the capacitor 142 must discharge through resistor 141, but will do so slowly, in accordance with the value of resistor 141. As the capacitor discharges, the voltage drop across the base-emitter junction will decrease, the voltage drop across the emitter-collector junction of transistor 139 will increase, and any LED 16 that is on will seem to "fade out," as the voltage across the LED decreases. Conversely, if the pulse-generating circuit (terminal 10) is low and the base-emitter junction of transistor 139 is biased low, then transistor 139 will be turned off. If the voltage then goes high, capacitor 142 will charge, but slowly, as the capacitor requires a period of time to charge. As the capacitor charges, the base-to-emitter voltage will increase, the voltage drop across the emitter-collector junction will decrease, and the lights will slowly "fade in" as the light turns on. Resistor 134 is desirably larger in the circuit of FIG. 13*a* than resistor 44 in FIG. 3, so that the flashing rate is reduced to accommodate the time (seconds) needed for a "fade-in" or "fadeout" effect. Switch 135 may be one or more switches as discussed above, including, but not limited to, an inertial switch, a push-button controllable "touch" switch for a period of illumination, or even a toggle on-off switch for longer illumination periods.

Figure 13B:
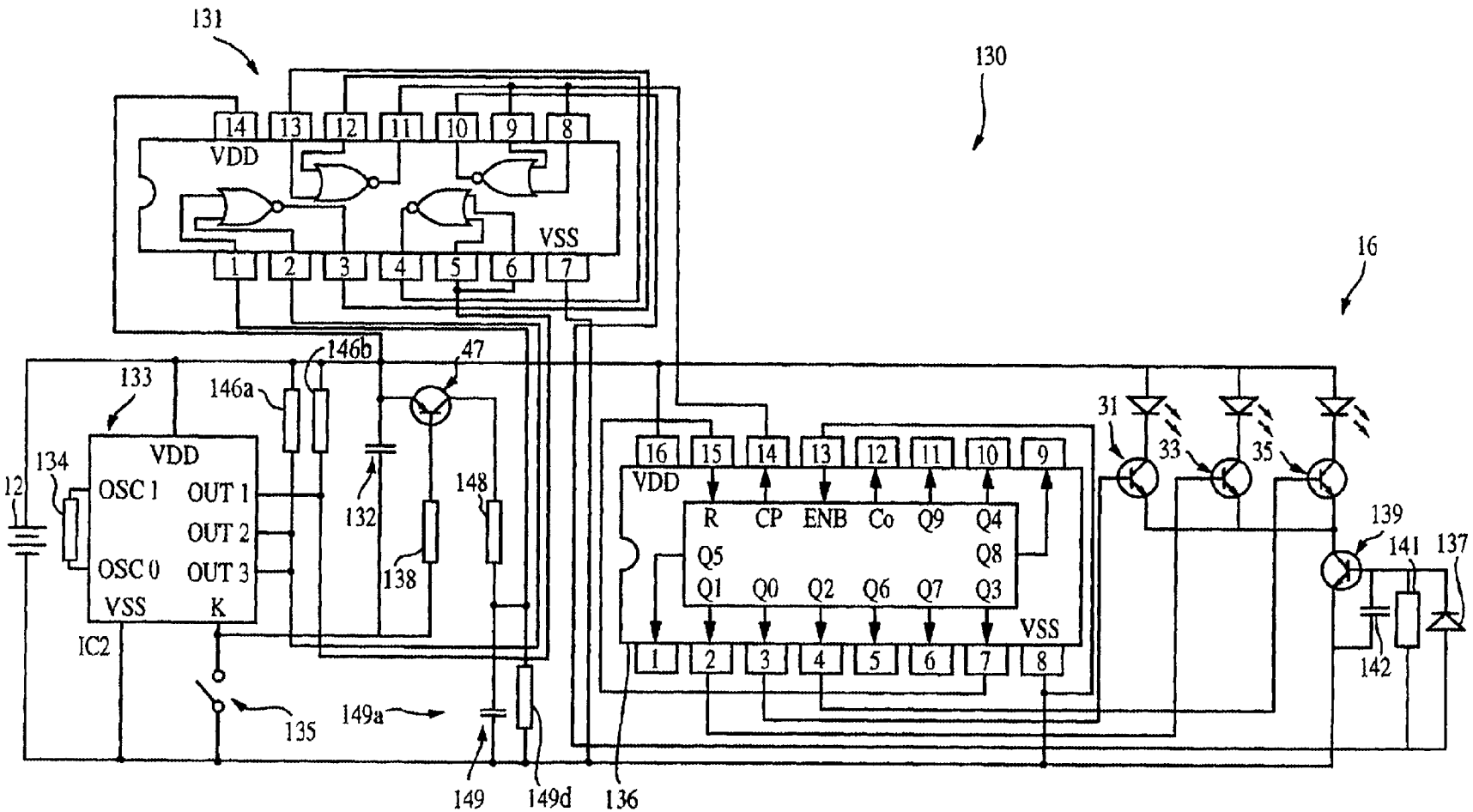
Figure 13C:
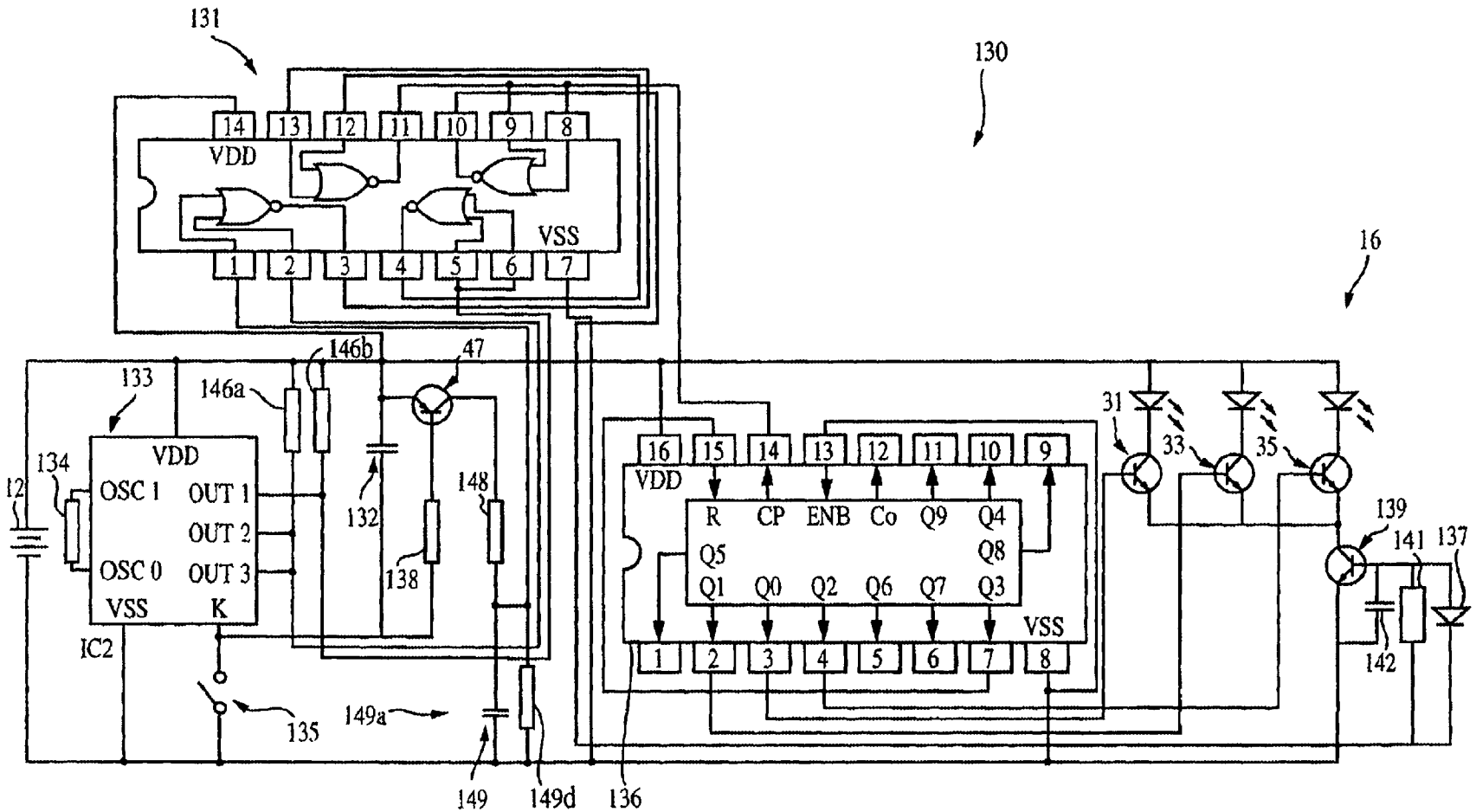

FIG. 13*b* is very similar to FIG. 13*a*, but is designed more for a fade-out circuit, in which the lamps will light up quickly, and then slowly fade off. In the embodiment shown in FIG. 13*a*, diode 137 has been added in parallel with resistor 141 to control primary control transistor 139. When the pulse-generating circuit 131 is turned on, the diode allows gate voltage to transistor 139, thus allowing a fast turn-on. However, when the circuit is turned off, the capacitor 142 retains a voltage to the transistor gate, and the capacitor can only discharge through resistor 141. This allows the LEDs 16 to slowly fade out. FIG. 13*c* is also very similar, but diode 137 is reversed. Now, when the pulse generating circuit 131 is turned on, the gate voltage must reach the transistor 139 through the resistor 141, at the same time charging capacitor 142. The LEDs 16 slowly fade on. When the circuit is turned off, however, the capacitor can discharge quickly through diode 137, and there is no "fade-out" effect. Diode 137 may be a 1N4148 diode. Other diodes may be used.

Figure 14:
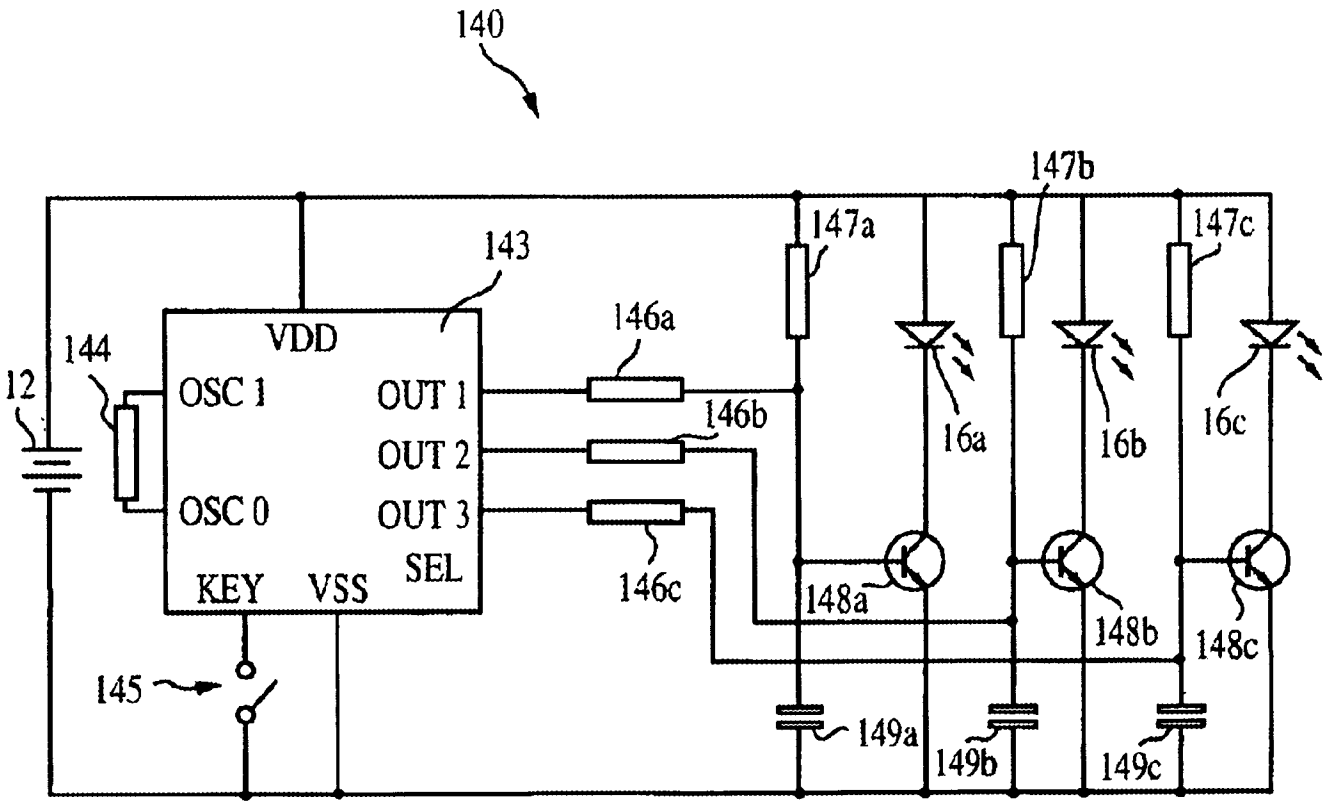

Another illumination circuit with a fading capability is depicted in FIG. 14. Illumination circuit 140 comprises a power supply 12, flash circuit 143 with resistor 144, switch 145, outputs OUT1, OUT2, OUT3, respectively 143, 143*b*, 143*c*, LEDs 16*a*, 16*b*, 16*c*, output resistors 146*a*, 146*b*, 146*c*, secondary npn control transistors 148*a*, 148*b*, 148*c*, individual resistors 147*a*, 147*b*, 147*c*, and individual capacitors 149*a*, 149*b*, 149*c*. A control capacitor is connected across the base and emitter of each npn transistor. In one embodiment, resistor 144 is 3 megohm, resistors 146*a*, 146*b* and 146*c* are 1K, resistors 147*a*, 147*b*, 147*c* are 680K, and capacitors 149*a*, 149*b* and 149*c* are 10 $\mu$F. Switch 145 is preferably an inertia switch, but other switches may also be used.

These circuits function in the same manner as that described for FIG. 13. If switch 145 was on and is now turned off, for example, OUT1 output will change from high to low. Capacitor 149*a* will be fully charged and must now discharge through resistor 146*a*. As the voltage at the base of transistor 148*a* decreases, transistor 148*a* will cease conducting, the resistance across the emitter-collector junction will increase, and LED 16*a* will "fade-out." After a period of time, or when switch 145 is turned on, the OUT1 output will change from low to high, and capacitor 149*a* will begin to charge through resistors 146*a* and 147*a*. The voltage at the base of transistor 148*a* will increase, the resistance across the emitter-collector junction of transistor 148*a* will decrease, and LED 16*a* will "fade-in." Logic circuitry in the flash circuit or elsewhere in the system may sequence the other LEDs in addition to OUT1 output and LED 16*a*, and LEDs 16*a*, 16*b* and 16*c* may turn on and turn off in sequence. The control circuit may be programmed to turn LEDs on and off in a random or unpredetermined manner. Alternatively, the lamps used in the circuit may turn on and off in any of the patterns discussed previously, including sequential lighting, alternating lights, forward and backward sequences, in-phase sequences, and so on. Fading in or out may also be combined with any of these sequences, for instance, a line of lamps on one side of a backpack in a downward sequence snapping on and then fading out, while a line of lamps on the other side of a backpack in an upward sequence fading in and snapping off. The entire sequence may be run with a first color of bi-color LEDs, and then repeated with the other color of the bi-color LEDs.

Figure 15A:
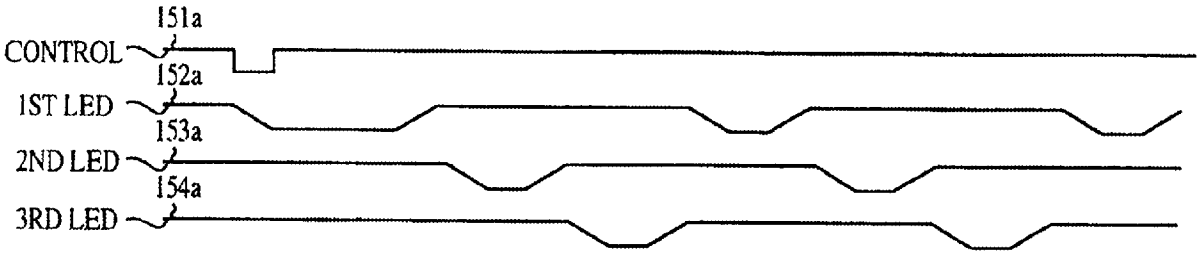
FIGS. 15*a*–15*c* depict illumination patterns possible with fade-in and fade-out circuits.
Figure 15B:
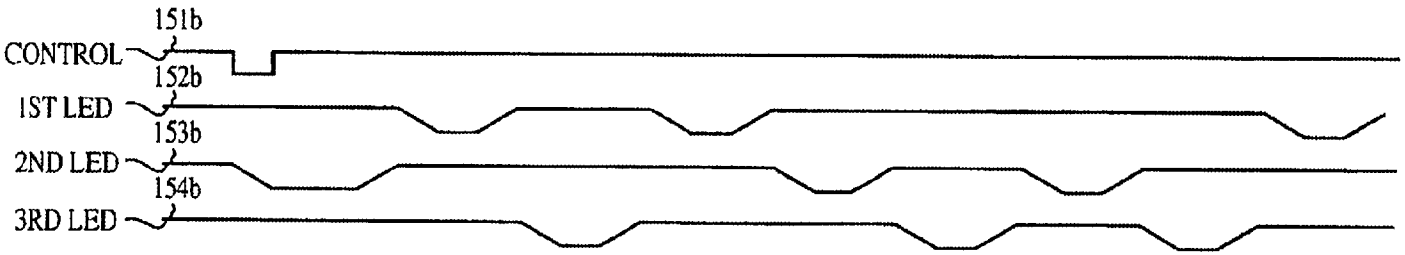
Figure 15C:
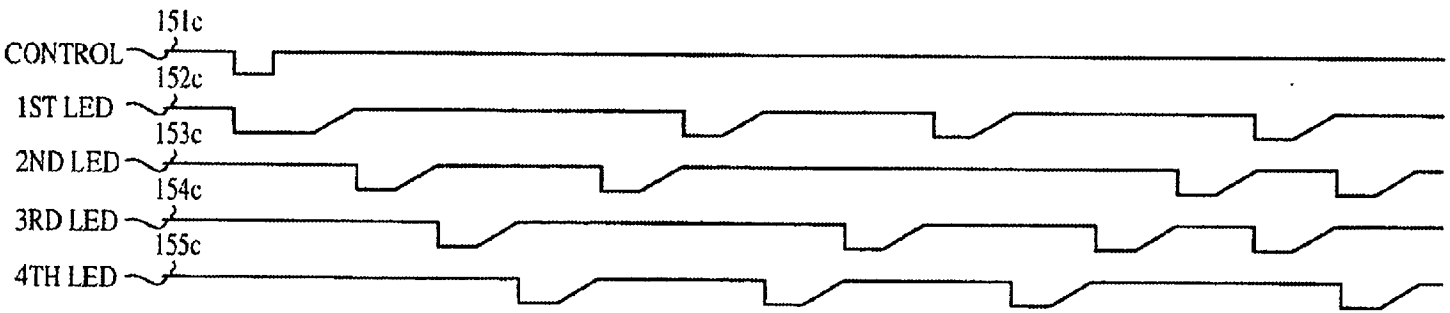
Figure 16:
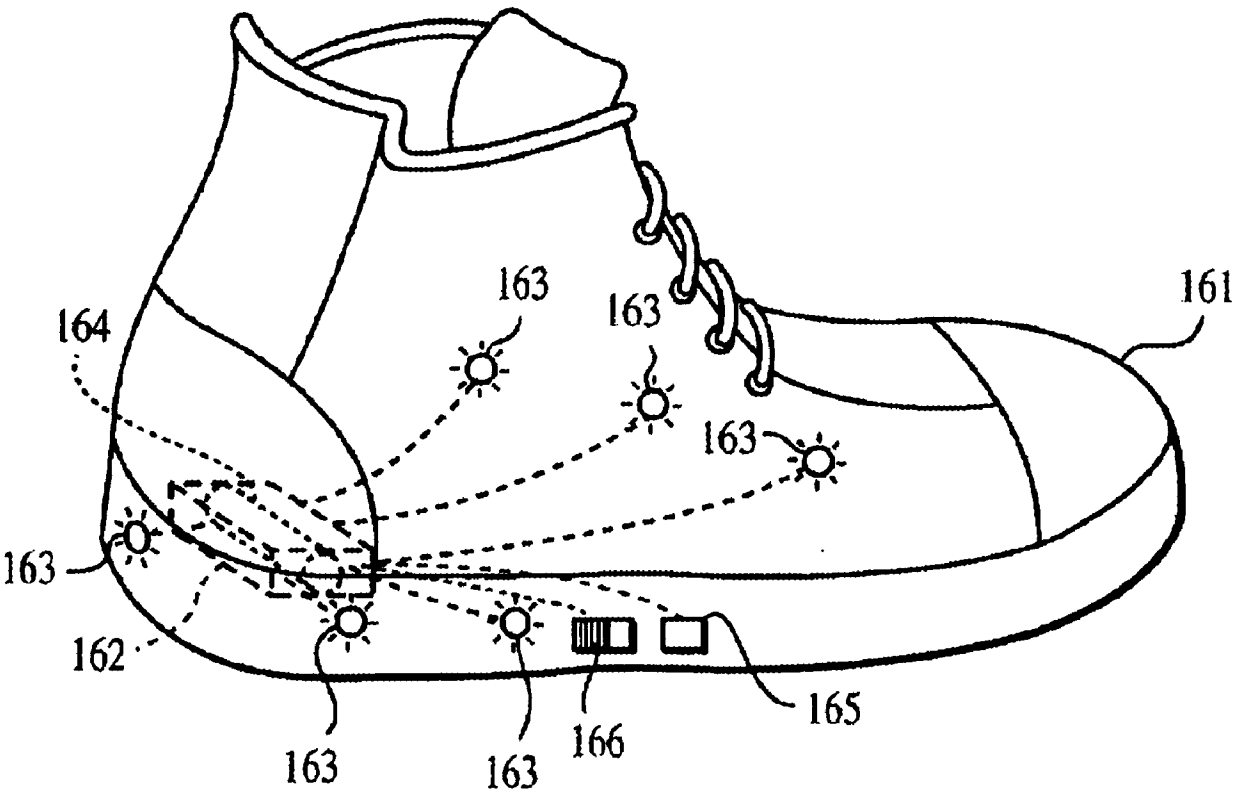
FIGS. 16–21 depict embodiments of articles using improved illumination systems.

The result of the "fade-in" and "fade-out" circuits is shown in FIGS. 15*a*, 15*b* and 15*c*, illustrating the lighting patterns shown by the LEDs. In each of these figures, there is a control trace, 151*a*, 151*b*, 151*c*, to indicate an assertion of the control system. The sloping traces then indicate rising or falling voltages to the lamps or LEDs. In FIG. 15*a*, the LEDs fade-in and fade-out in sequence with different on times, as shown by traces 152*a*, 153*a*, 154*a*, with the downward sloping lines meaning "fade-in" and the upward sloping lines meaning "fade-out." In FIG. 15*b*, the LEDs, as shown by traces 152*b*, 153*b*, 154*b*, fade-in and fade-out in a random sequence, again with different on times. In FIG. 15*c*, there are four LEDs, with no fade-in and only a fade-out, as shown by traces 152*c*, 153*c*, 154*c* and 155*c*. When the switch is actuated, they turn on in a random sequence, and more than one LED may be turned on at a time. Of course, many different numbers of LEDs may be used on any flashing light system of the present disclosure.

Figure 17:
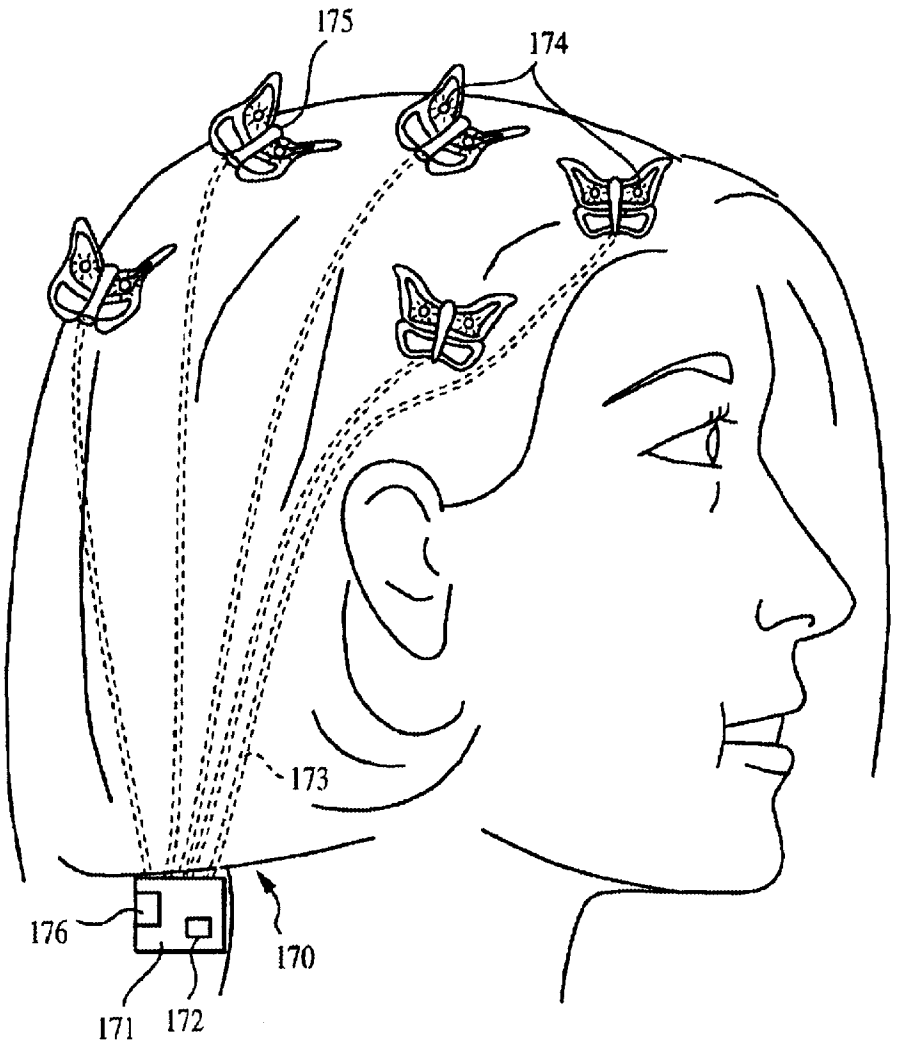

There are many applications for the illuminating systems described above. Such illuminating systems may be used on a variety of personal clothing and accessory items. FIGS. 16–20 depict a few of these items, including FIG. 16, with a shoe 161 that incorporates the illuminating system 162 with two-color, two-lead LEDs 163, and having an inertial switch 164 and a touch switch 165. The touch switch may be used to initiate or to change illumination patterns, as described above. The system also includes a toggle switch 166 for disconnecting the power supply (internal 3V battery) from the circuit. FIG. 17 depicts another application, using an LED in each of a plurality of hair clips for a woman. Illumination system 170 includes a system power and control portion 171 and a touch-switch 172 for turning the systems and LEDs on. The system includes a plurality of connector elements 173 connecting system controls 171 with LEDs 174 on hair clips 175. The control system may also have a toggle switch 176 to disconnect the battery from the rest of the circuit, conserving power.

Figure 18:
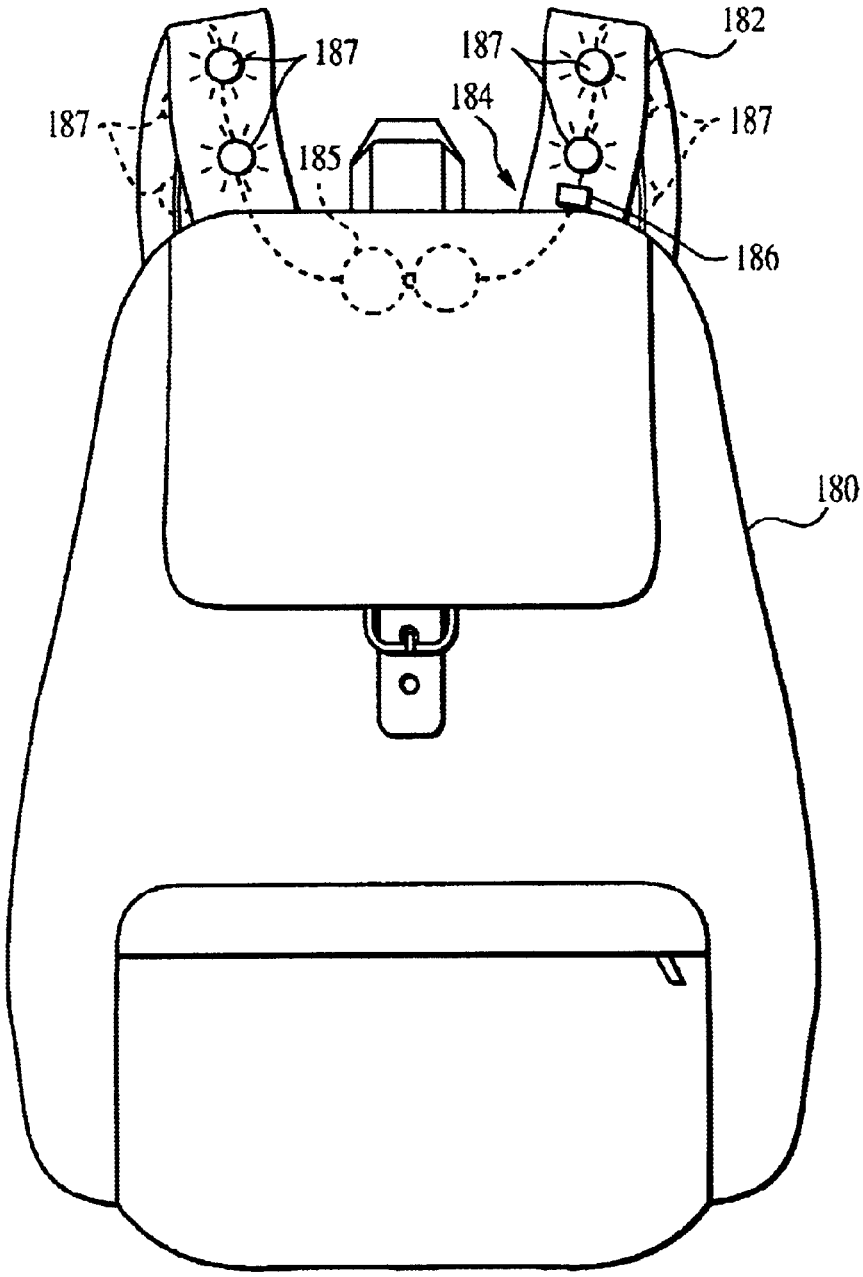

FIG. 18 depicts another application, a back pack 180 with straps 182 for displaying a plurality of flashing LEDs. In this application, the illumination system 184 includes a power and control portion 185, a touch switch 186 for turning the system on and off, and a series of two-color (red/green) three-lead LEDs 187 on the straps of the backpack. The system power and control portion 185 may be contained in the top flap of the backpack. In this application, the control system may be programmed to alternate red-color LEDs on the left side with red-color LEDs or green-color LEDs on the right side, or vice-versa, in sequence. Of course, two-color LEDs in other colors may also be used, any colors commercially available, and there is no intention to limit this application to two-color LEDs alone. Single-color LEDs may also be used. This is also a good application for in-phase illuminating, in which the LEDs closest to the pack are illuminated, and then the middle pair, and finally the pair farthest away form the back pack, and so on. Other sequences or random flashing may also be used.

Figure 19:
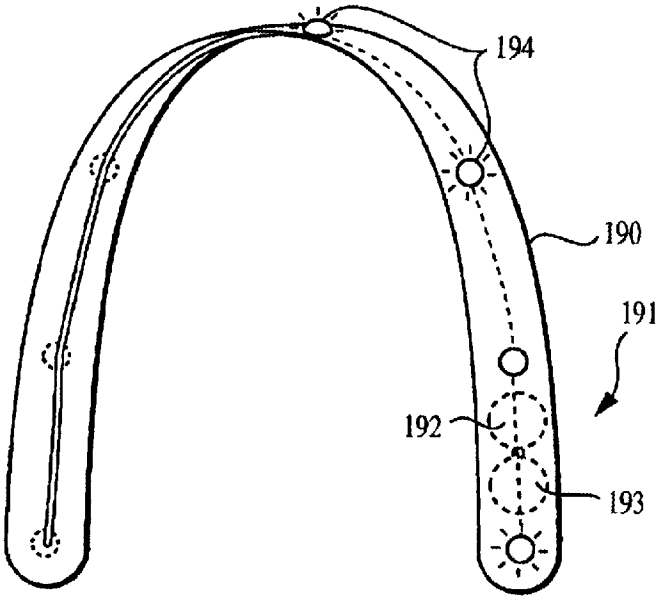
Figure 20:
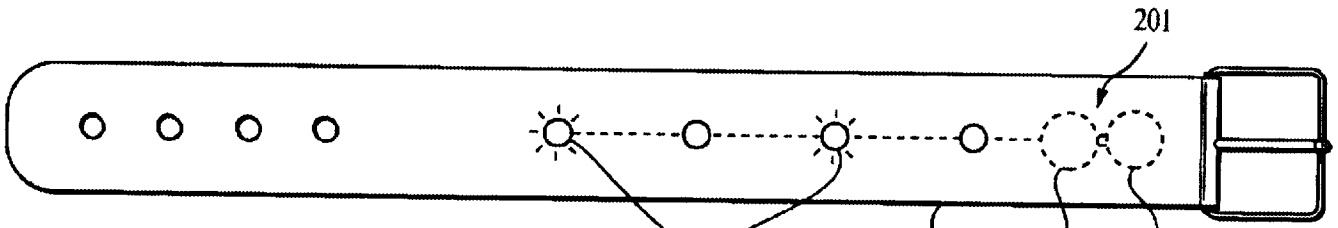
Figure 21:
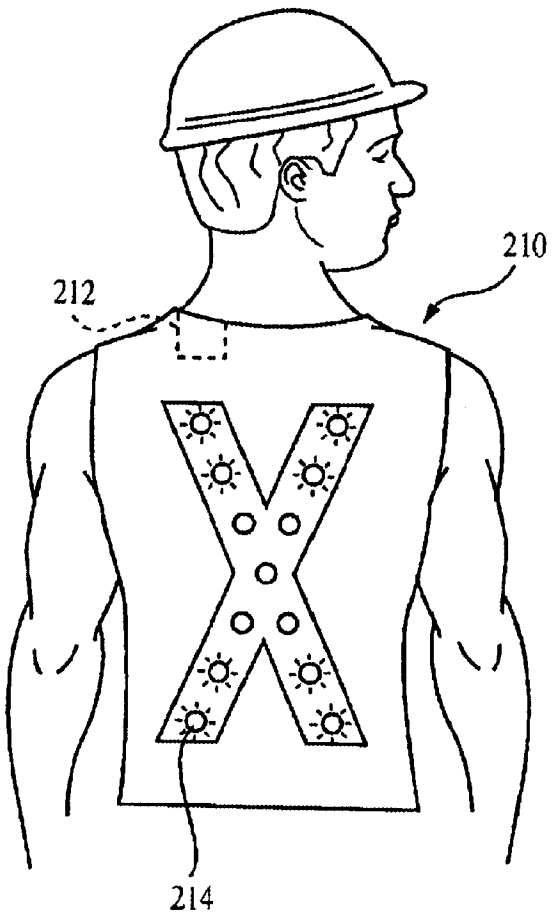

Other items which may desirably employ embodiments of a flashing light system include the hairpiece of FIG. 19, a belt, as shown in FIG. 20, and a garment, such as a safety vest for a highway construction worker, shown in FIG. 21. The hairpiece 190 is desirably made of plastic in an attractive and stylish fashion. There may be niches in the underside of the piece to accommodate the power and control portion 192 of the illuminating system 191. It may also be convenient to mold in at least one niche for a control switch 193 for a user to control the illumination or flashing patterns of the system 191. The LEDs 194 are then displayed on the top-side of the hair piece for decorative and stylistic purposes. A belt 200 may also incorporate a system 201 of flashing lights 203. In this application, the belt has a small space on its underside for attachment of the control system 202 (including a switch) and power supply 204. The LEDs 203 are also strung on the underside and protrude through to the outside of the belt. FIG. 21 depicts a highway worker wearing a safety vest with a flashing light system 210, including control and power supply portions 212 and a pattern of lights 214 in the shape of a large "X" on the vest. Other garments may also be equipped with a flashing light system, such as a coat, a pair of pants, or a protective suit. Any of these circuits may incorporate the features discussed above, including bi-color LEDs, a toggle-switch to turn off the circuit, a fader circuit to fade a lamp in or out, and a touch-switch to increment and control the flashing.

It will be understood that embodiments covered by claims below will include those with one of the above switches, as well as two or more of these switches, so that economy of operation may be achieved, while at the same time providing for a variety of pleasing applications. Thus, one embodiment may have a toggle switch both for economy of operation and for continual flashing, and may also have a touch-button switch for changing the pattern of the lights flashing from one pattern to another. Either of these embodiments may also incorporate an inertial switch, which may act to re-charge a timing circuit and may also change the pattern of flashing.

Any of the several improvements may be used in combination with other features, whether or not explicitly described as such. Other embodiments are possible within the scope of this invention and will be apparent to those of ordinary skill in the art. For instance, some transistor/capacitor circuits for a "fade-in" or "fade-out" embodiment have been described with npn transistors and a capacitor connected to the base and emitter of the transistor. Embodiments are also possible with pnp transistors and with capacitors connected across the base and collector of the pnp transistor. Therefore, the invention is not limited to the specific details, representative embodiments, and illustrated examples in this description. Accordingly, the invention is not to be restricted except in light as necessitated by the accompanying claims and their equivalents.

What is claimed is:

1. An illuminating system for a personal item, the system comprising:

a switch for controlling the illuminating system;

a plurality of gates;

means for storing and generating at least two patterns of signals that control the gates, the means for storing and generating connected to the plurality of gates and the switch, the at least two patterns stored in a memory of the system;

a plurality of lamps for illuminating the personal item, the plurality of lamps selected from the group consisting of incandescent lamps, LEDs, bi-color LEDs, and tri-color LEDs, wherein the means for storing and generating causes the plurality of lamps to flash in a pattern selected by a user with the switch.

2. The system of claim 1, wherein the personal item is selected from the group consisting of a shoe, a shoe lace, a back-pack, a hair care item, a belt, a garment and an outer garment.

3. The system of claim 1, wherein the pattern is selected from the group consisting of a random pattern, a sequence, a reverse sequence, a pattern with a delay, an in-phase pattern, fading in and fading out.

4. The system of claim 1, further comprising means for controlling a length of time the illuminating system is turned on, the means selected from the group consisting of a diode, a switch, a resistor and a capacitor, an oscillator and a microprocessor controller.

5. The system of claim 1, wherein the switch is selected from the group consisting of an inertial switch, a touch switch and an on/off switch.

6. The system of claim 1, further comprising a power supply connected to at least the means for storing and generating.

7. The system of claim 1, further comprising a primary gate connected electrically to the gates.

8. The system of claim 7, wherein the primary gate is a transistor and further comprising a capacitor connected between a base of the transistor and a terminal selected from the group consisting of a collector and an emitter of the transistor.

9. The system of claim 7, wherein the primary gate is a transistor and further comprising a diode connected between a gate of the transistor and the means for storing and generating at least two patterns of signals.

10. The system of claim 7, wherein the primary gate is a transistor and further comprising a resistor and a diode connected between a gate of the primary transistor and the means for storing and generating at least two patterns of signals.

11. The system of claim 10, further comprising a capacitor connected between a gate and an emitter or collector of the primary transistor.

12. The system of claim 1, wherein at least two of the gates comprise transistors and further comprising a capacitor for each of the at least two transistors, the capacitor connected between a base of the transistor and a terminal of the transistor selected from the group consisting of a collector and an emitter of the transistor.

13. An illuminating system for a personal item, the system comprising:

a power supply;

a primary gate connected electrically to the power supply;

at least two switches for controlling the primary gate, the switches electrically connected to the primary gate and the power supply;

a plurality of secondary gates electrically connected to the primary gate and the power supply;

means for storing and generating a pattern of signals that control the secondary gates, the means for generating connected to the plurality of secondary gates and the power supply, the pattern of signals stored in a memory of the system;

a plurality of lamps for illuminating the personal item, the plurality of lamps selected from the group consisting of incandescent lamps, LEDs, bi-color LEDs, and tri-color LEDs, wherein a user selects a pattern with at least one of the switches and the means for generating causes the plurality of lamps to flash in the selected pattern.

14. The system of claim 13, wherein at least one of the primary gate and the secondary gates is a transistor, and further comprising a capacitor for at least one transistor that is a primary gate or a secondary gate, said capacitor connected electrically to a base of the transistor and to a terminal selected from the group consisting of a collector and an emitter of the transistor.

15. The system of claim 13, wherein the personal item is selected from the group consisting of a shoe, a shoe lace, a back-pack, a hair care item, a belt, a garment and an outer garment.

16. The system of claim 13, wherein the pattern is selected from the group consisting of a random pattern, a sequence, a reverse sequence, a pattern with a delay, an in-phase pattern, fading in and fading out.

17. The system of claim 13, further comprising means for controlling a length of time the illuminating system is turned on, the means selected from the group consisting of at least one of the switches, a diode, a resistor and a capacitor, an oscillator, and a microprocessor controller.

18. The system of claim 13, wherein the switches for controlling the primary gate are selected from the group consisting of an inertial switch, a touch switch and an on/off switch.

19. The system of claim 13, wherein the primary gate is a transistor and further comprising a diode connected between a gate of the transistor and the means for storing and generating a pattern of signals.

20. The system of claim 13, wherein the primary gate is a transistor and further comprising a resistor and a diode connected between a gate of the primary transistor and the means for storing and generating at least two patterns of signals.

21. The system of claim 20, further comprising a capacitor connected between a gate and an emitter or collector of the primary transistor.

* * * * *